US008528278B2

(12) United States Patent
Sippola

(10) Patent No.: US 8,528,278 B2
(45) **Date of Patent: *Sep. 10, 2013**

(54) EMBEDMENT TILE WITH REPLACEABLE TOP PLATE

(75) Inventor: Duane F. Sippola, Madison, WI (US)

(73) Assignee: MetaDome, LLC, Madison, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/587,046

(22) Filed: Aug. 16, 2012

(65) Prior Publication Data

US 2013/0042550 A1 Feb. 21, 2013

Related U.S. Application Data

(63) Continuation of application No. 12/462,398, filed on Aug. 3, 2009, now Pat. No. 8,261,497, which is a continuation-in-part of application No. 12/077,739, filed on Mar. 20, 2008, now Pat. No. 8,146,302, which is a continuation-in-part of application No. 11/371,550, filed on Mar. 9, 2006, now Pat. No. 7,845,122, which is a continuation-in-part of application No. 10/951,240, filed on Sep. 27, 2004, now abandoned.

(60) Provisional application No. 60/505,794, filed on Sep. 25, 2003, provisional application No. 60/660,529, filed on Mar. 10, 2005.

(51) Int. Cl.
*E04F 11/16* (2006.01)

(52) U.S. Cl.
USPC ..... 52/177; 52/180

(58) Field of Classification Search
USPC ..... 52/177, 180, 191, 588.1
See application file for complete search history.

(56) References Cited

U.S. PATENT DOCUMENTS

| | | | | |
|---|---|---|---|---|
| 731,158 | A | 6/1903 | Blackmore | |
| 1,412,504 | A | 4/1922 | Byrne | |
| 1,429,400 | A * | 9/1922 | Bloedow et al. | 52/588.1 |
| 2,478,993 | A * | 8/1949 | Wing | 52/483.1 |
| 2,485,165 | A | 10/1949 | Pollman | |
| 3,222,040 | A | 12/1965 | Eckert | |
| 3,311,939 | A | 4/1967 | Yamamoto et al. | |
| 3,447,731 | A | 6/1969 | Lehmann | |
| 3,620,027 | A * | 11/1971 | Nordell | 405/219 |
| 3,802,790 | A | 4/1974 | Blackburn | |
| 3,841,776 | A * | 10/1974 | Klaus | 404/41 |
| 3,902,255 | A | 9/1975 | Harte | |
| 4,331,218 | A | 5/1982 | Layher | |

(Continued)

FOREIGN PATENT DOCUMENTS

WO WO 02/086247 A1 * 10/2002

OTHER PUBLICATIONS

Photographs of Prior Art Advantage Tactile Embedment Tile dated Jan. 12, 2009, 5pp.

(Continued)

*Primary Examiner* — Basil Katcheves
(74) *Attorney, Agent, or Firm* — Smith Law Office

(57) ABSTRACT

An embedment tile with a replaceable upper plate and a lower plate joined by fasteners in a manner that permits replacement of the upper plate when desired. The embedment tile upper plate comprises a plate having a pattern of upwardly extending projections on its upper surface forming a tactilely detectable pattern.

8 Claims, 32 Drawing Sheets

(56) References Cited

U.S. PATENT DOCUMENTS

| | | | | |
|---|---|---|---|---|
| 4,377,016 | A | 3/1983 | Niermeijer | |
| 4,706,424 | A | 11/1987 | Garapick et al. | |
| 4,715,743 | A | 12/1987 | Schmanski | |
| 4,883,394 | A * | 11/1989 | Van der Woude et al. | 411/51 |
| 5,009,045 | A | 4/1991 | Yoder | |
| 5,052,161 | A | 10/1991 | Whitacre | |
| 5,217,319 | A * | 6/1993 | Klohn | 404/15 |
| 5,303,669 | A | 4/1994 | Szekely | |
| 5,385,770 | A | 1/1995 | Julnes | |
| 5,399,406 | A | 3/1995 | Matsuo et al. | |
| 5,403,637 | A * | 4/1995 | Pickard et al. | 428/44 |
| 5,619,832 | A | 4/1997 | Myrvold | |
| 5,775,835 | A | 7/1998 | Szekely | |
| 6,199,340 | B1 | 3/2001 | Davis | |
| 6,449,790 | B1 | 9/2002 | Szekely | |
| 6,450,728 | B1 | 9/2002 | Grahmbeek et al. | |
| 6,588,975 | B2 | 7/2003 | Ross | |
| 6,594,961 | B2 | 7/2003 | Leines | |
| 6,607,329 | B2 | 8/2003 | Smith | |
| 6,663,315 | B2 | 12/2003 | Smith | |
| 6,688,805 | B1 | 2/2004 | Kochling | |
| 6,715,956 | B1 | 4/2004 | Weber et al. | |
| 6,718,714 | B1 | 4/2004 | Montgomery, Sr. | |
| 6,895,622 | B2 | 5/2005 | Szekely | |
| 7,007,437 | B2 | 3/2006 | Thomas | |
| 7,080,954 | B2 * | 7/2006 | Monneret et al. | 404/25 |
| 7,771,814 | B2 | 8/2010 | Grimble et al. | |
| 7,779,581 | B2 | 8/2010 | Flaherty et al. | |
| 7,845,122 | B2 | 12/2010 | Sippola | |
| 8,146,302 | B2 | 4/2012 | Sippola | |
| 2004/0042850 | A1 | 3/2004 | Provenzano, III | |
| 2005/0066623 | A1 | 3/2005 | Sippola | |
| 2010/0129150 | A1 | 5/2010 | Sippola | |

OTHER PUBLICATIONS

Drawing of Prior Art Advantage Tactile Systems Embedment Tile, 1p.

Drawing of Prior Art Armor—Tile Embedment Tile, 1p.

U.S. Appl. No. 60/660,529, filed Mar. 10, 2005.

U.S. Appl. No. 60/505,794, filed Sep. 25, 2003.

* cited by examiner 200
210

214
212
220

222

210
220

EMBEDMENT TILE WITH REPLACEABLE TOP PLATE

This is a continuation of U.S. application Ser. No. 12/462,398 filed Aug. 3, 2009, which is a continuation-in-part of pending U.S. application Ser. No. 12/077,739 filed Mar. 20, 2008, which is a continuation-in-part of U.S. application Ser. No. 11/371,550 filed Mar. 9, 2006, which was a continuation-in-part of U.S. application Ser. No. 10/951,240 filed Sep. 27, 2004, now abandoned, which claimed priority to U.S. Provisional Application No. 60/505,794 filed Sep. 25, 2003. U.S. application Ser. No. 11/371,550 also claims the benefit of U.S. Provisional Application No. 60/660,529 filed Mar. 10, 2005. All of the above-referenced applications are incorporated herein by reference in their entireties.

FIELD AND BACKGROUND OF THE INVENTION

The Department of Justice (DOJ), the lead agency that oversees the Americans with Disabilities Act (ADA), has mandated that many municipalities and other governmental bodies comply with certain regulations regarding accessibility. One such regulation deals with accessibility on walkways in public right of ways. In brief, it requires that surfaces of those walkways enable tactile detection by visually impaired persons.

One of the primary ways of providing the ability to detect proximity to hazardous locations (e.g., roadways, railroad crossings, etc.) is by modifying the surface texture of the walkways. Tactilely detectable warnings are distinctive surface patterns of domes detectable by cane or underfoot, and are used to alert people with vision impairments of their approach to streets and hazardous drop-offs. The ADA Accessibility Guidelines (ADAAG) require these warnings on the surface of curb ramps, which remove a tactile cue otherwise provided by curb faces, and at other areas where pedestrian ways blend with vehicular ways. They are also required along the edges of boarding platforms in transit facilities and at the perimeter of reflecting pools.

Complying with the federal mandate is requiring the expenditure of much time and money by the municipalities to modify the surface textures of their sidewalks and other walkways. The need for a tactile warning device that is cost effective is essential to enable municipalities to comply with the ADA unfunded mandates. It is also needed by non-governmental entities, such as land developers, railroad companies and others who likewise need to provide tactile-detectable surfaces at curb ramps, platforms and the like.

Some embedded tile devices currently exist for providing tactilely detectable warning surfaces for the visually impaired in concrete walkways. Once embedded in moldable walkway materials such as concrete or asphalt, these devices form a truncated dome portion of the surface that is detectable to people on foot.

However, most of these devices are made out of plastic and are flimsy, being subject to ultraviolet light damage, deterioration and cracking in short periods of time. Also, inherent to the truncated dome design is the exposure of domes to severe impacts by snowplow equipment, particularly snowplow blades and end-loader buckets. Domes made of plastic tend to be sheared off, nicked or cracked when snowplows hit them. Once damaged, repair requires that entire plastic embedded tiles be removed and replaced. The fact that plastic embedded tile devices are easily damaged results in high long-term costs to maintaining truncated dome surfaces when they are employed. Yet, current manufactures of plastic embedded tile devices either do not warrant the devices or warrant them for no more than five years. Public entities cannot afford to replace truncated dome devices every five years—nor every ten to fifteen years for that matter. A more durable device is needed.

Information somewhat relevant to attempts to address these problems can be found in U.S. Pat. Nos. 5,775,835 to Szekely; U.S. Pat. No. 6,449,790 to Szekely; U.S. Pat. No. 6,715,956 TO Weber et al.; and, U.S. Patent Application Publication US 2004/0042850 to Provenzano, III. However, each one of these references suffers from one or more of the following disadvantages: (1) they do not enable embedment of a tile in moldable materials such as concrete or asphalt; (2) they lack means for securely interlocking a tile with the moldable material; (3) they result in build-up of moldable material around the edges of the tile when inserted, resulting in longer installation times due to the need for removal of the buildup prior to finishing; (4) the tiles do not provide means for internal air release and therefore allow trapped air pockets to obstruct the efficient movement of air and moldable material when the tile is sunk, making embedment more time-consuming and difficult, and often requiring the application of weights to prevent the tile from floating while the moldable material sets; and, (5) the tiles are not made of materials that stand up to the cracking and sheering effects of snowplows or other heavy equipment, thus resulting in high maintenance costs over time.

For the foregoing reasons there is a need for an embedment tile device that is designed to be both easily installable to minimize installation time and cost, and durable to minimize long-term maintenance costs and to reliably provide tactilely detectable surfaces.

The embedment tiles of the present invention are well-anchored and durable. Nonetheless, embedment plates in accordance with the present invention, as well as all other known embedment plates, are subject to damage from snow plows, construction equipment, and corrosive materials. Further, some existing tactile surfaces fail to comply with appropriate governmental standards because, for example, they do not have raised and truncated cones on their surface.

Removing non-compliant or damaged embedment tiles and installing new embedment tiles requires breaking concrete or asphalt in the area around and under the damaged embedment plate, cleaning and preparing the area for new concrete or asphalt, placing concrete or asphalt, and embedding a new tile. Such a process in time-consuming, relatively expensive, and subject to shoddy construction practices that could result in delamination of the new concrete or asphalt from existing materials. Replacement tiles have been installed over the top of damaged tiles, but matching size and contour, as well as drilling holes for fasteners, is difficult and time-consuming. Thus, it would be desirable to have simple and efficient apparatus and methods for repairing damaged embedment tiles.

SUMMARY OF THE INVENTION

In accordance with the present invention, there is provided an embedment tile having a replaceable top plate, such that an upper plate that is non-compliant, damaged, or requires replacement for any other reason can be easily removed, replaced, and secured with fasteners to a lower plate of the embedment tile. The lower plate and the upper plate can both have raised conical domes of similar size, spacing, and shape such that they nest and resist damage better than a single plate surface of an embedment tile.

The two plates can be joined together by nuts and bolts, and in particular can be joined with nuts secured to the lower plate and bolts that extend through holes in the upper plate and are threaded into the nuts.

The double plated embedment tile can be preassembled at a factory and initially installed in the same way a single plate embedment tile is installed, as described herein. When the upper plate requires replacement, the bolts are removed, the upper plate is removed, the new upper plate is set and nested (if a matching tactile surface is provided) on top of the lower plate, and the bolts (or new bolts) are threaded into nuts on the lower plate. Other types of anchoring systems can also be used to secure the upper plate.

Alternatively, the double plated embedment tile can be initially installed with only the lower plate so that the upper plate is added after the lower plate portion is embedded in moldable material. Such an installment method reduces the overall weight of the embedment tile for ease of installation.

Further, with the upper plate removed, the embedment tile lower plate can include air vents to allow air to escape from under the embedment tile during installation. Air vents are particularly useful in the conical domes of the lower plate because they allow air pockets under the domes to escape and moldable material to fill the undersides of the domes to reinforce the domes from snow plow damage, for example.

The present invention is also directed to an embedment tile and method that satisfy this need for a device that is designed to be both easily installable to minimize installation time and cost, and durable to minimize long-term maintenance costs and to reliably provide tactilely detectable warning surfaces. Cross beams with hollow chambers are provided on the underside of the embedment tile of the present invention to enable movement of air and moldable material into the interior of the cross beams during installation thus enabling air release as well as movement of moldable material internal to the tile's cross beams. In this way, the formation of air pockets under the tile member that might otherwise resist embedment of the tile, and prevent the material from flowing smoothly to fill the spaces between the cross beams and under the lower surface of the tile more completely, is minimized. Once set, the moldable material internal to the cross beams serves to further secure the tile in place in the walkway.

One version of the embedment tile for embedment in a moldable material such as concrete or asphalt, comprises a tile member substantially planar in form, having an upper surface and a lower surface and two or more sides defining side edges, the upper surface having a plurality of projections extending upward there from in a tactilely detectable pattern; and, two or more cross beams projecting downward a distance from the lower surface of the tile member, each cross beam comprising a hollow chamber and a sidewall, the sidewall having two sides defining side edges and two ends defining a length of the cross beam there between, each sidewall being shaped so as to define the hollow chamber interior to and running the length of each cross beam and so as to define an opening at each end, the hollow chamber of each cross beam being in communication with an exterior via the opening at each end so as to allow air and moldable material located under the tile member to move into the hollow chambers of the cross beams during embedment of the tile in the moldable material, whereby an embedment tile is provided with cross beams having hollow chambers that allow for air release and movement of moldable material internal to the cross beams of the tile during embedment so as to ease and speed installation and to secure embedment of the tile into the moldable material.

In another version, air release means are provided for enhancing communication between the hollow chamber of one or more of the cross beams and the exterior so as to further enable air and moldable material to move into the hollow chamber from the exterior via said air release means during installation of the tile. The air release means may consist of one or more apertures located in the sidewall of the one or more cross beams. Alternatively, the air release means may consist of a gap formed where one side edge of the sidewall of each of said one or more cross beams approaches but does not attach to the lower surface of the tile member, the space between said side edge and the lower surface of the tile member defining the gap, the opposing edge of the sidewall connecting the cross beam to the lower surface of the tile member.

the sidewall of one or more of the cross beams is connected to the lower surface of the tile member by one of its two side edges, the other side edge approaching but not attaching to the lower surface of the tile member, instead defining a gap between it and the lower surface through which air and moldable material may move into the hollow chamber of the cross beam, thus further promoting movement of air and moldable material into the interior hollow chamber of the cross beams.

In another version, the sidewall further consists of one or more apertures and the hollow chamber of each cross beam is further in communication with the exterior via the one or more apertures.

In another version the projections on the upper surface of the tile member consist of a surface rising from a perimeter to a central top portion, the surface having a plurality of reinforcement ridges thereon, each reinforcement ridge extending from the perimeter toward the central top portion of the projection and functioning to reinforce the projection against damage from objects such as snow plows impacting its surface.

In yet another version, the embedment tile further consists of support members. Support members are attached to the lower surface of the tile member and project downward a distance there from, the distance defining a depth of the support member, the depth of the support member being greater than that of the two or more cross beams and comprising a sidewall having two opposing ends which define a length there between, the sidewall being shaped so as to define a hollow channel extending the length and an opening at each end, the chamber being in communication with the exterior at each end via the openings, whereby the moldable material is displaced around and into the openings of the support members as the embedment tile is lowered into the material. The support members may also function to support the tile member during installation.

In another embodiment of the present invention, the embedment tile is essentially the same as described above except for the cross beam construction. The cross beam in an alternate embodiment defines a substantially closed chamber with openings into the chamber through which a moldable material flows or is pushed. The ends of this cross beam are open and the ends of the side walls of the cross beam are tapered from top to bottom to define edges that can more easily penetrate fresh concrete. Preferably, the edges are curved to permit easier installation of the embedment tile. This arrangement also defines an opening in the lower side of a cross beam end that permits moldable material to more easily flow into the chamber, as opposed to a beam that is closed at the bottom and only open at its end.

In still another embedment tile in accordance with the present invention, the cross beam can be any of the cross beams disclosed herein, except that adjacent to one or more cross beams is a reinforcing member secured directly or indirectly to the bottom of the embedment plate. The reinforcing member preferably is a channel shape that opens in a downward direction.

Also preferably, the channel member is formed integrally with the adjacent cross beam to simplify construction because forming two members simultaneously is less expensive and more rigid, and attachment to the underside of the embedment plate is simplified. The reinforcing member provides additional rigidity to the embedment tile during and after installation.

In another embodiment of an embedment tile in accordance with the present invention, there is a transverse beam attached to the underside of the plate which extends at a substantially right angle to the cross beam. The transverse beam provides still more rigidity to the embedment tile. The transverse beam is preferably channel-shaped in cross section and open downward for ease of embedment into fresh concrete.

Also preferably, the transverse beam is positioned at the end of a cross beam and adjacent to an edge of the embedment plate. The transverse beam can be welded or otherwise attached to the underside of the embedment plate, and can be a separate member from the cross beam or connected to the cross beam for ease of attachment to the underside of the plate.

In other versions, the upper surface of the tile member may be skid-resistant, all or a portion of the embedment tile may be manufactured out of stainless steel, and/or its projections may consist of a surface of truncated domes distributed in a warning pattern compliant with the Americans with Disabilities Act Accessibility Guidelines.

In other versions, methods for making a tactilely detectable surface using the embedment tile as described above are disclosed.

Several objects and advantages of the present invention are:

providing an embedment tile with cross beams on its lower surface designed with hollow chambers, openings therein to enable air trapped under the tile during embedment to move into the hollow chambers the openings and further air release means, thus affecting internal air release and minimizing air pocket obstructions to the smooth movement of moldable material into and around the cross beams and toward the lower surface and sides during embedment of the tile;

means for providing tactilely detectable warning surfaces (or other surface patterns such as way-finder, decorative and the like) that are both efficiently installed and durable to enable entities to comply with ADA Accessibility Guidelines, or other requirements, rapidly and cost-effectively;

means for providing tactilely detectable surfaces in moldable materials such as concrete and asphalt efficiently and reliably so as to save installation time and labor costs;

means for providing tactilely detectable surfaces in moldable materials such as concrete and asphalt durably so as to minimize the need for replacement and thereby, the long-term costs of maintenance, by providing embedment tiles that last at least as long as the surrounding materials;

means for providing embedment tiles that are reusable in order to conserve materials and to minimize replacement costs; and, means for providing embedment tiles with improved recyclability so as to maximally conserve environmental resources.

The reader is advised that this summary is not meant to be exhaustive. Further features, aspects, and advantages of the present invention will become better understood with reference to the following description, accompanying drawings and appended claims.

BRIEF DESCRIPTION OF THE DRAWINGS

For a better understanding of the present invention, reference may be made to the accompanying drawings, in which:

FIGS. 12*c*-12*f* show versions of cross beams 300 that attach at both side edges, or portions of the sidewalls proximate thereto;

FIG. 14*b*, shows the detail "A" of FIG. 14*a*, enlarged to show apertures and the location of a cross beam perpendicularly to another aligned to allow optional insertion of reinforcement bars there through;

DETAILED DESCRIPTION OF THE PREFERRED EMBODIMENTS

Figure 1A:
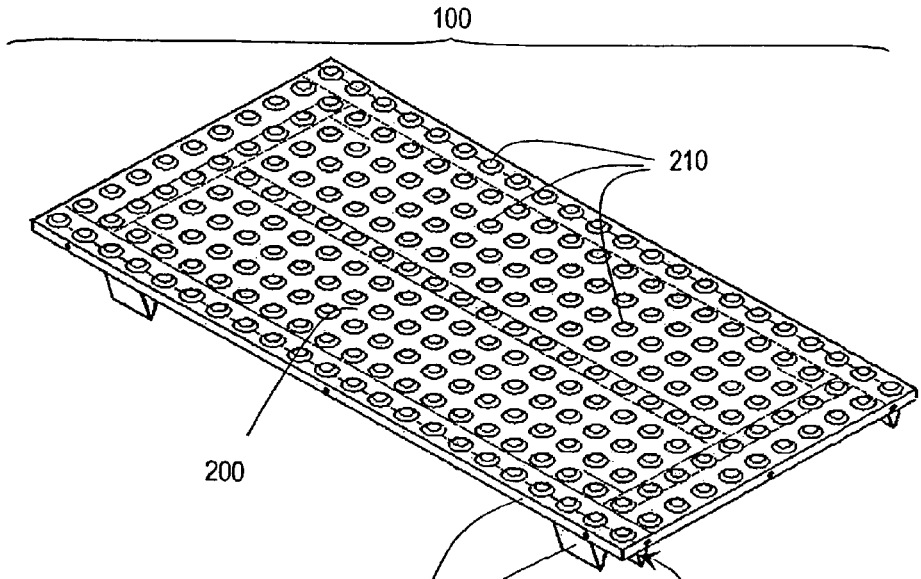
FIG. 1*a*, shows a top perspective view of a version of the embedment tile 100 of the present invention.

Referring now specifically to the figures, in which identical or similar parts are designated by the same reference numerals throughout, a detailed description of the present invention is given. It should be understood that the following detailed description relates to the best presently known embodiment(s) of the invention. However, the present invention can assume numerous other embodiments, as will become apparent to those skilled in the art, without departing from the appended claims. For example, though the present embedment tile is described relative to embedment in moldable materials such as concrete or asphalt, it may also be embedded in other types of materials. Also, though the tactilely detectable surface of the embedment tile is described as producing a warning pattern compliant with ADA Accessibility Guidelines, any pattern may be produced, including way-finder patterns, purely decorative patterns, emblematic patterns or patterns of other sorts.

It should also be understood that, while the methods disclosed herein may be described and shown with reference to particular steps performed in a particular order, these steps may be combined, sub-divided, or re-ordered to form an equivalent method without departing from the teachings of the present invention. Accordingly, unless specifically indicated herein, the order and grouping of the steps is not a limitation of the present invention.

Detailed Description—Embedment Tile

Figure 1B:
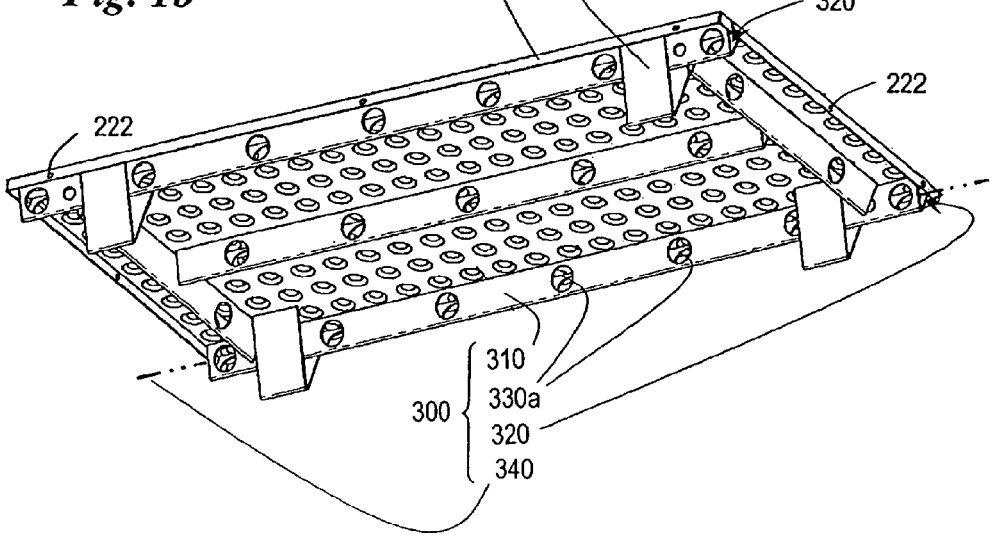
FIG. 1*b*, shows a bottom perspective view of the version of the embedment tile 100 depicted in FIG. 1*a;*

Referring to FIGS. 1*a* and 1*b*, one version of the embedment tile device of the present invention is depicted. This version of the embedment tile device 100 is designed for embedment in walkways made of moldable materials 900 such as concrete or asphalt (see FIGS. 6*a*-6*f* for depictions of embedment of tiles into materials 900), in order to bring them into compliance with the Americans with Disabilities Act Accessibility Guidelines (ADAAG) by producing tactilely detectable warning surfaces. Though the accompanying drawings and following description relate to use of the embedment tile 100 for creating tactilely detectible warning surfaces, the reader is reminded that the tiles 100 may be used to produce other surface patterns in a variety of places other than walkways specifically, and in a variety of moldable materials 900 other than concrete and asphalt.

The embedment tile 100 comprises a tile member 200 and two or more cross beams 300. It may also comprise air release means 300 (*a* or *b*) and optionally also two or more support members 400.

The tile member 200 is substantially planar in form, having an upper surface (shown in FIGS. 1*a*, 2*a*, and 3*a*) and a lower surface (shown in FIGS. 1*b*, 5, 7*a*, and 11*a*) and two or more sides defining side edges. As depicted in most of the figures, the tile member 200 has 4 side edges. However, the same design can be constructed to meet the needs of a user for different shapes, including, for example, skewed curb ramp approaches, blended sidewalk approaches, sides of curb ramp approaches and the like where the number of side edges may vary (see FIGS. 4*a*-4*c* for examples of 2-, 3-, and 4-sided versions, respectively, with detail of one type of triangular tile member shown at FIG. 4*d*). Tile members 200 may further be cut for customized fitting to certain areas.

Figures 2A, 2B, 2C, 2D:
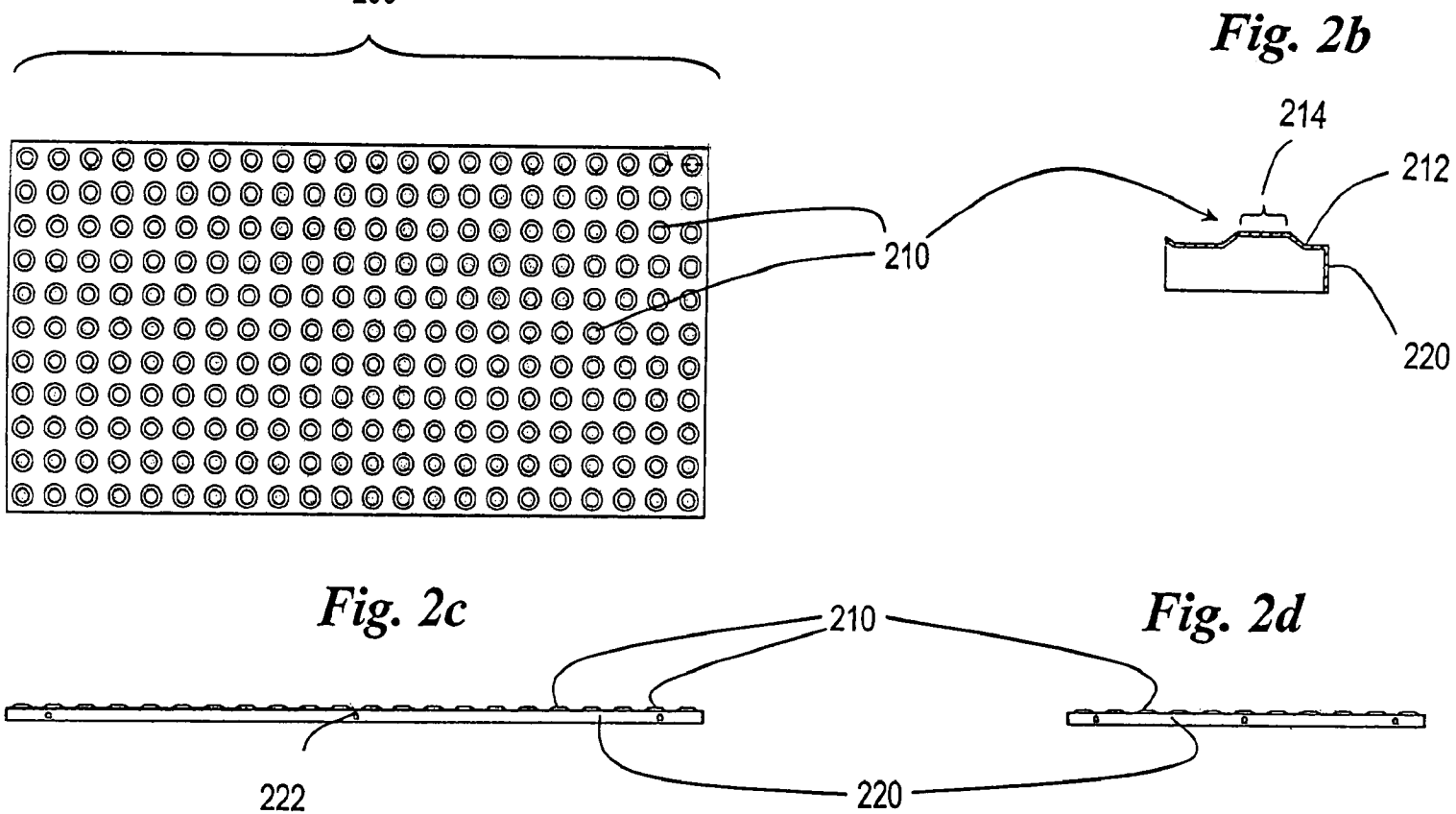
FIG. 2*a*, shows a top view detail of the tile member 200 depicted in the embedment tile of FIG. 1*a;*
FIG. 2*b*, shows the cross section indicated in FIG. 2*a* (i.e. B-B), detailing a projection 210 and an optional edge flange 220 of the tile member 200.
FIG. 2*c*, shows a side view (both sides being alike) of the tile member 200 depicted in FIG. 2*a;*
FIG. 2*d*, shows an end view (both ends being alike) of the tile member 200 depicted in FIG. 2*a;*
Figure 3B:
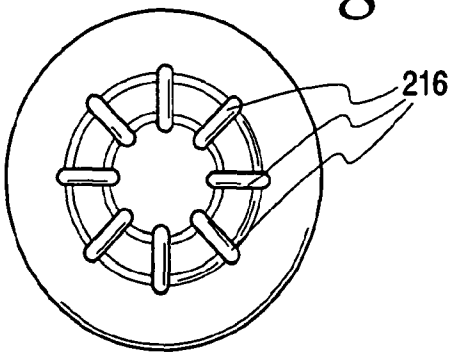
FIG. 3*b*, shows a detailed top view of the ridged projection of FIG. 3*a;*
Figure 3C:
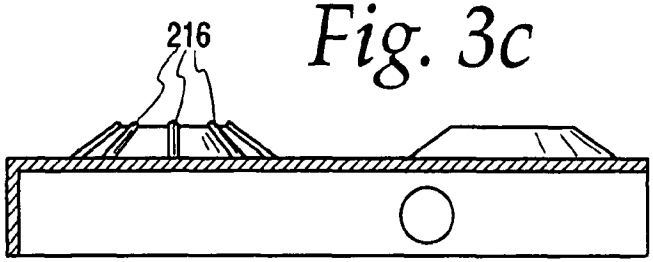
FIG. 3*c*, shows a cross sectional view of two projections 210 denoted in FIG. 3*a* as cross-section C-C, on the left a projection with reinforcement ridges 216 and on the right a projection without reinforcement ridges.
Figure 3A:
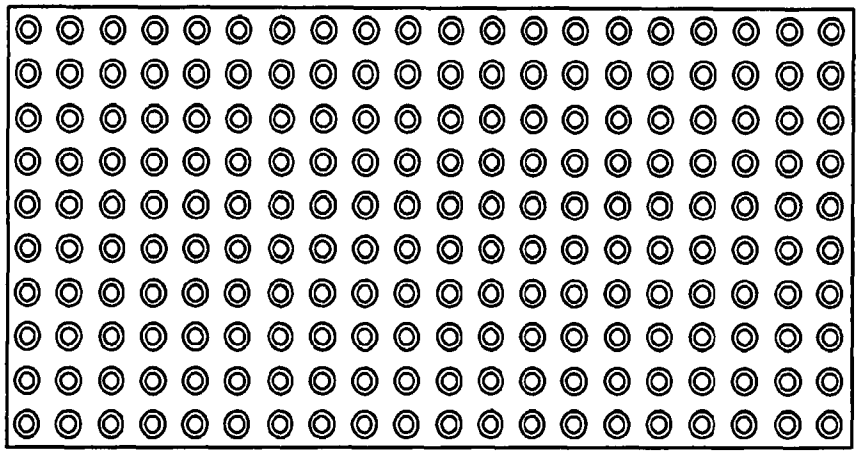
FIG. 3*a*, shows a top view of a tile member 200 similar to that of FIG. 2*a*, but showing a version of a projection 210 having reinforcement ridges 216 thereon in the upper left corner.
Figure 4A:
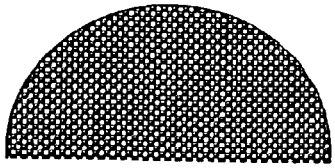
FIGS. 4*a* to 4*d*, show top views of tile members 200 varying in number of sides from 2-sided to 3- and 4-sided, respectively, with FIG. 4*d* showing a top perspective view of one version of an embedment tile 100, having a 3-sided tile member 200.
Figure 4B:
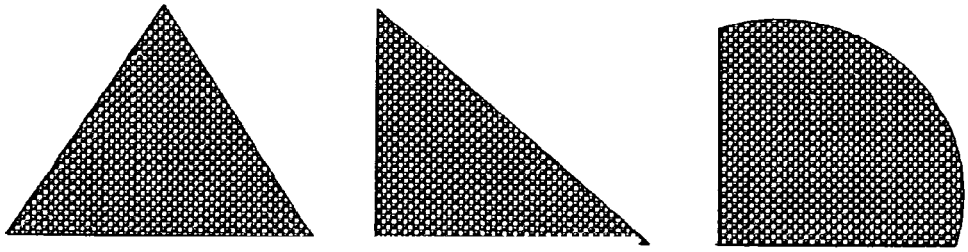
Figure 4C:
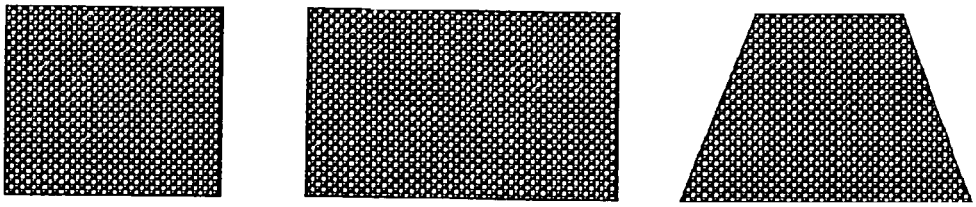
Figure 4D:
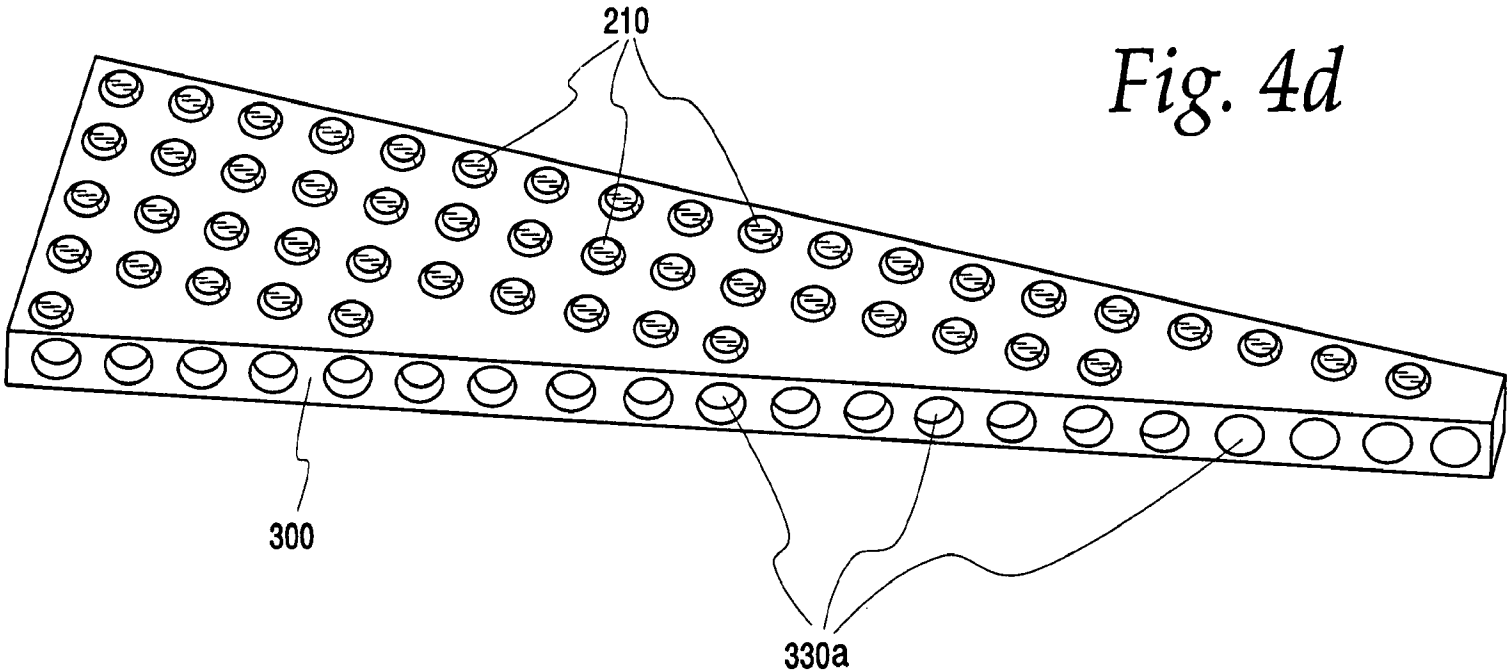

The tile member 200's upper surface comprises many projections 210 extending upward from the surface (see FIGS. 1*a*, 2*a*, and 3*a*). Each projection 210 generally consists of a surface rising from a perimeter 212 to a central top portion 214 (FIG. 2*b*). As shown in the figures, the projections 210 are shaped like truncated domes where the projection's surface rises from a circular perimeter 212 to a flattened central top portion 214 (i.e., forming the truncated dome). Also as depicted, these projections 210 are distributed in a tactilely detectable warning pattern, i.e., the domes 210 are distributed in a matrix of rows and columns in conformance with the ADAAG. As the ADA guidelines evolve over time or as users require conformance with other guidelines, the projections 210 may be altered in form, size, distribution pattern and spacing to meet those new requirements. For example, users may require the projections 210 to form a way-finder pattern, decorative design or some other pattern.

The projections 210 may further comprise several reinforcement ridges 216 (see FIG. 3*a*-3*c*). Reinforced ridges 216 function to strengthen projections 210 so that they are better able to endure impacts from other objects, to better protect the tile's surface coatings from wear, and to enhance the slip-resistance of the domes 210 themselves.

FIG. 3*c* shows one truncated dome 210 with ridges 216 (on left) and one dome 210 without ridges 216 (on right) to illustrate the difference. In FIG. 3*b*, a top view is given to show that, in this particular version, 8 reinforcement ridges 216 are distributed evenly along the sides of the dome 210, extending from the perimeter 212 of each dome toward the center top portion 214, in this case extending slightly above the edge of the truncated top surface of the dome 210. In this way, an object impacting the dome 210 from any side, such as the blade of a snow plow when directed over a tile 100, would first hit one or more of the reinforcement ridges 216 on several of the domes 210. The ridge(s) 216 which would in turn lesson and/or divert impact of the object up and over the tops of the domes 210, thereby protect the domes. Likewise, the surface coating of the domes, including coatings on the top surface of the domes, would also be protected. In this way the reinforcement ridges 216 function to protect not only the underlying domes themselves but also the coatings on the surfaces of the domes. This results in higher durability of both the domes and the coatings, reducing the frequency with which either needs to be replaced.

The number, distribution pattern and sizing of the ridges 216 may vary according to the particular application and the particular type and sizing of upwardly extending projections 210 (e.g., according to whether the projections 210 are formed as truncated domes, diamonds or otherwise). The sizes depicted in FIGS. 3*a*-3*c* (inches [cm]), are given by way of example only.

The reinforcement ridges 216 may be formed by various methods. In versions of embedment tiles 100 made from sheets of stainless steel or other metals, the domes 210 complete with reinforcement ridges 216 may be formed using a press. Other alternatives to forming the upwardly extending projections complete with ridges 216 may be employed, including forming them by molding or otherwise depending on the materials used (e.g., plastics, etc.).

Referring to FIGS. 2*a* to 2*d*, detailed views of the version of the tile member 200 depicted in FIG. 1*a* are provided. A top view is provided in FIG. 2*a*, side view in FIG. 2*c* and an end view in FIG. 2*d*. FIG. 2*b* shows a cross-sectional view through one of the truncated dome projections 210 and one edge of the tile member 200 (defined as section B-B in FIG. 2*a*).

Note that in FIGS. 2*b* to 2*d*, a vertical flange 220 is shown extending vertically downward from each edge of the tile member 200. Vertical flanges 220 are optional. When present, however, the vertical flanges 220 may function to further stabilize the tile member 200 and enable the easy connection of additional embedment tiles 100 as may be necessary to extend or expand surface projection areas by bolting them together at the flanges 220 (note that bolt holes 222 are shown in the vertical flanges 220 as depicted in FIGS. 1*a*-1*b*, 2*c*-2*d*). Alternatively, in versions with cross beams 300 located at the edges of a tile member 200, bolt holes 222 may be located in the sidewalls 310 of the cross beams (see, e.g., FIG. 7*b*).

As mentioned above, the size of the tile member 200 as well as its shape and number of sides may vary depending on a user's needs (see shape variations in FIGS. 4*a*-4*d*). By way of example, in one version as depicted in FIGS. 1*a*, 1*b*, and 2*a*-2*d*, the tile member is about 24.0 inches (61 cm) wide by 48.0 inches (122 cm) long. Many other shapes and sizes are possible, including 2 foot square versions (24.0×24.0 inches; 61×61 cm) and the like.

The upper surface of the tile member 200 may further be conditioned or surfaced so as to provide skid-resistance. For example, if the tile member 200 is made of a metal material, such as stainless steel, the upper surface might be etched or otherwise surfaced to provide skid-resistance. In addition or alternatively, the upper surface may be coated with a material to improve or provide its skid-resistant quality. Color for improved visual contrast of the embedment tile 100 may further be provided by treatment of the embedment tile 100's material itself, and/or by coating it with a colorant. A variety of techniques may be used to impart the embedment tile 100 with long-lasting color contrasting and skid resistance.

Figure 5:
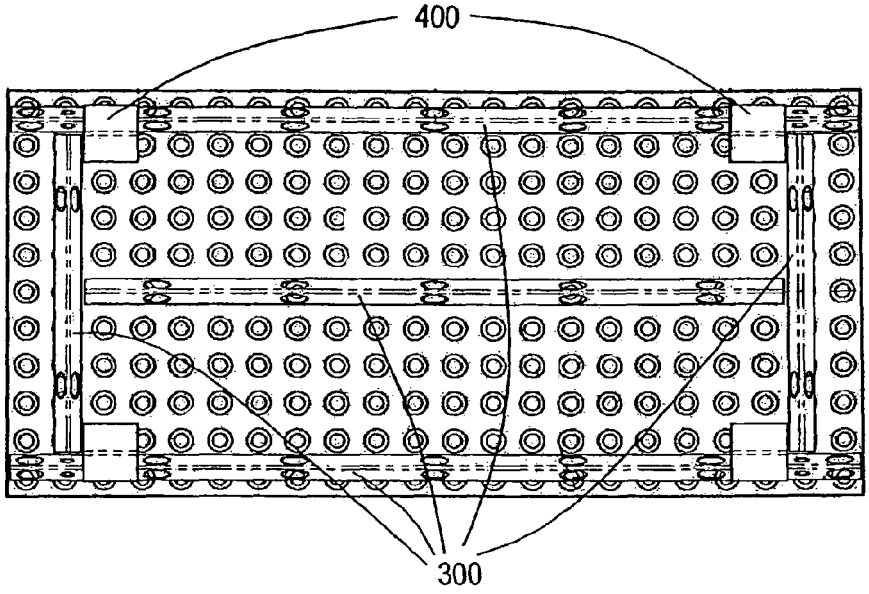
FIG. 5, shows a bottom view of the embedment tile depicted in FIGS. 1*a* and 1*b*, showing cross beams 300 and support members 400.

The embedment tile 100 further comprises two or more cross beams 300 that are attached to and project downward a distance from the lower surface of the tile member 200, the distance defining a depth 360 of the cross beams 300 (see FIGS. 1*b* and 5, in which five cross beams 300 are shown; see FIG. 8 for example of an individual cross beam noting depth dimension 360; see below for discussion of other versions of cross beams 300).

Each cross beam 300 generally consists of a hollow chamber 340 and a sidewall 310. The sidewall 310 has two sides defining side edges and two ends defining a length of the cross beam there between. The sidewall 310 is shaped (via bending, molding or the like) so as to define the 3-dimensional shape of the cross beam 300, to define and to enclose, or substantially enclose, a hollow chamber 340 interior to and running the length of each cross beam 300, and to define an opening 320 at each end. The hollow chamber 340 of each cross beam is in communication with the exterior via the openings 240 at each end so as to allow air 910 and moldable material 900 located under the tile member 200 to move into the hollow chambers 340 of the two or more cross beams via the openings 320 during embedment of the tile in the moldable material 900.

In this way, the hollow chambers 340 of the cross beams 300 allow for air release and movement of moldable material 900 internal to the cross beams (i.e., into their interior hollow channels) during embedment. All of the air 910 trapped under the tile 100 as it is lowered into the moldable material 900, need not move out to the edges of the tile member 200. Instead, most may move into the hollow chambers 340 of the cross beams 300. This greatly improves ease and speed of installation because it prevents formation of air pockets that would otherwise be trapped under the tile member 200 and prevent smooth movement of material 900 up between the cross beams 300. Because some of the moldable material 900 also may move into the hollow chambers 340 of the cross beams 300, embedment of the tile into the moldable material 900 is further secured once it sets.

The tile 100 may further consist of air release means 330 (*a* or *b*) for enhancing communication between the hollow chamber 340 of one or more of the cross beams 300 and the exterior so as to further enable air 910 and moldable material 900 to move into the hollow chamber from the exterior via the air release means 330*a,b* during installation of the tile (see FIGS. 6*a-f*). Inclusion of air release means 330*a,b* may particularly improve installation when the length of the cross beams 300 approaches that of the tile member 200 (versus shorter lengths where the openings 320 alone provide sufficient air release).

Figure 6A:
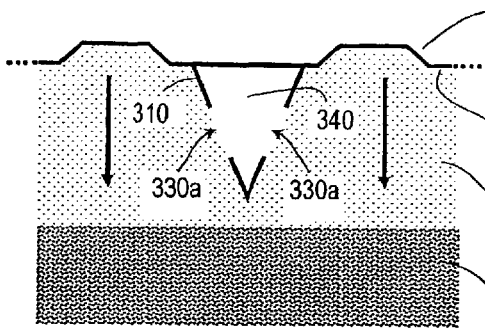
FIGS. 6*a*-6*f*, depict how air 910 and moldable material 900 exterior to a cross beam 300 move into the hollow chamber 340 of the cross beam when the tile is lowered during installation, arrows indicating direction of flow of the air 910 (white arrows) and of the moldable material (curved black arrows) as they are displaced by the cross beam 300 [FIGS. 6*a*-6*c* showing movement through apertures 330*a*, and FIGS. 6*d*-6*f* showing movement through a gap 330*b];*
Figure 6D:
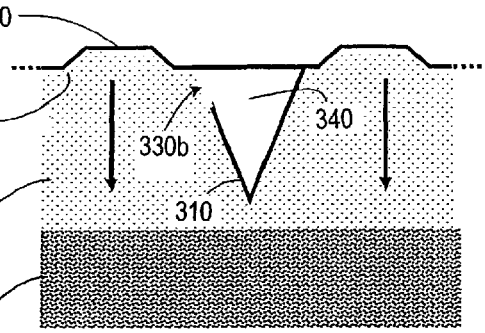
Figure 6B:
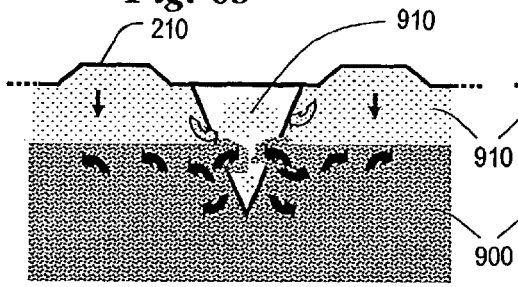
Figure 6E:
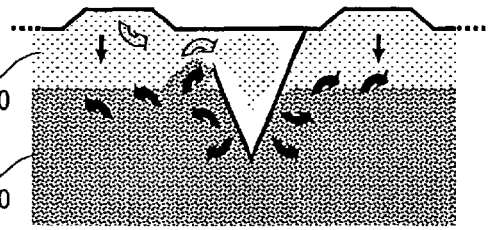
Figure 6C:
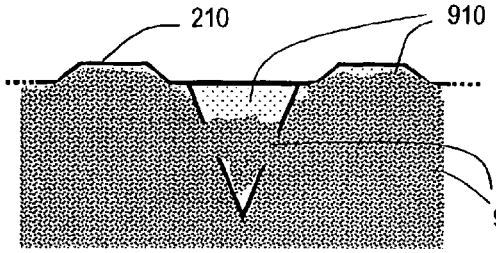
Figure 6F:
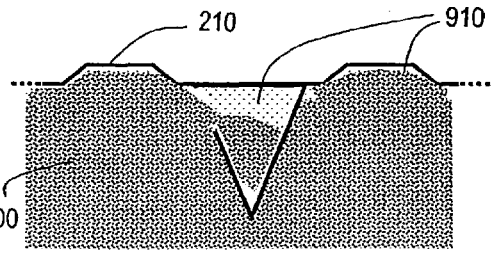

The air release means may comprise one or more apertures 330*a* located in the sidewall 310 of one or more of the cross beams 300 (see FIGS. 6*a-c*, also, most of the figures in which cross beams are depicted). Alternatively, the air release means may comprise a gap 330*b* formed where one side edge of the sidewall 310 of each of the one or more cross beams 300 approaches but does not attach to the lower surface of the tile member, the space between the side edge and the lower surface of the tile member 200 defining the gap 330*b* (see FIGS. 6*d-f*; see also FIG. 7*b*, 12*a-b*). In this case, the opposing edge of the sidewall 310 connects the cross beam 300 to the lower surface of the tile member 200.

Provision of air release means in the form of apertures 330*a* in the sidewalls 310 and/or gaps 330*b* between side edges of the sidewalls 310 and the lower surface of the tile member 200, promotes greater air release during installation further promoting ease and rapidity of the installation process [see FIGS. 6*a*-6*d* for illustrations of the internal air release process in cross sectional view of a cross-beam having apertures 330*a* (FIGS. 6*a*-6*c*) and having a gap 330*b* (FIGS. 6*d-f*) and below for further discussion of these features].

Without the hollow chamber 340 in communication with the exterior (via the openings and/or air release means 300*a* and/or 300*b*), pockets of trapped air 910 would form under the tile as it is lowered during installation and the air pockets would exert a force upward against the lower surface of the tile member 200, thus resisting insertion of the tile into the material 900. This situation often requires the use of weights during installation in order to keep the tile 100 in place at the desired grade. Free from the resistance of air pockets, the embedment tile 100 of the present invention meets with little resistance and eases into the moldable material 900 flawlessly and rapidly for efficient installation. Air pockets 910 also prevent even flow of moldable material 900 to fill the areas between the cross beams 300 and up against the lower surface of the tile member 200. Thus, enabling release of air pockets 910 into the interior hollow chambers 340 of the cross beams 300 of the present invention, further removes the air pocket obstacle to smooth flow of moldable materials 900 up to more fully fill the spaces between the cross beams 300 and under the lower surface of the tile member 200. More complete filling of those spaces with moldable materials 900 further strengthens support for the tile member 200 once installed.

Figure 7A:
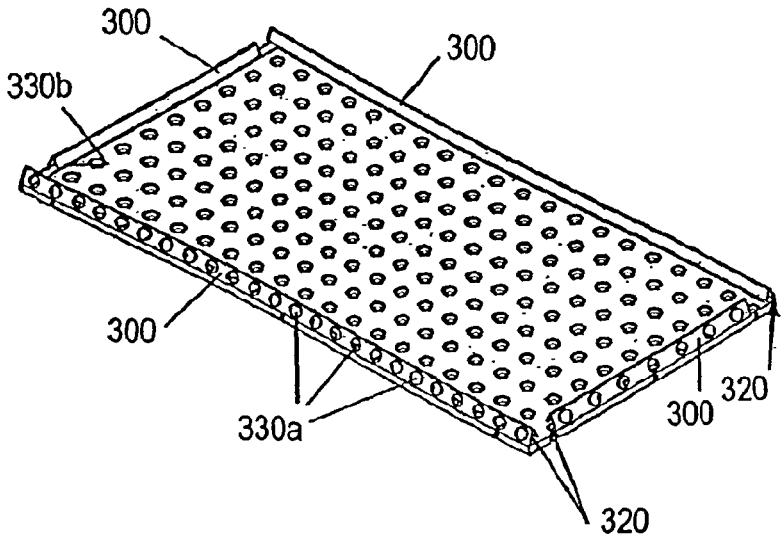
FIGS. 7*a*, shows a bottom perspective view of one version of the embedment tile 100 of the present invention having cross beams 300 extending downward from each side edge of the tile member 200.
Figure 7B:
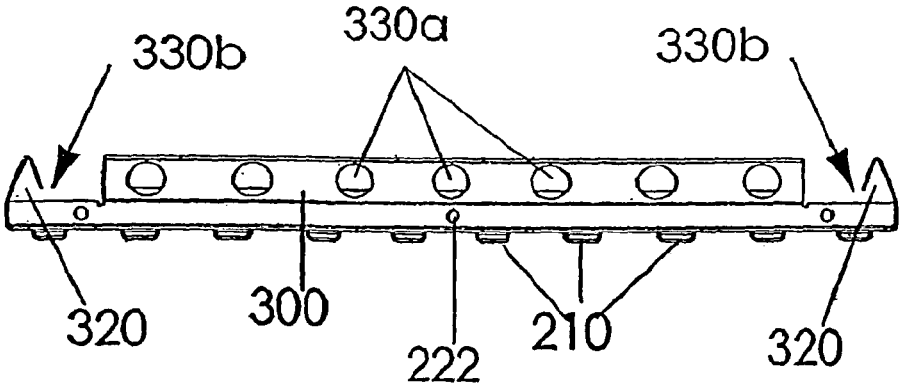
FIG. 7*b*, shows an end-view of the embedment tile of FIG. 7*a*, detailing certain of the structures, including air release means that include both gaps 330*b* and apertures 330*a* in the cross beams 300 (similar in cross section to the cross beam depicted at FIG. 12*b*)

Gap air release means 330*b*, are formed when the sidewall 310 of one or more of the cross beams 300 connects to the lower surface of the tile member 200 by one of its two side edges, the other side edge approaching but not attaching to the lower surface of the tile member 200, thus instead defining the gap 330*b* between it and the lower surface (see FIGS. 7*a*-7*b* for a version of the tile 100 showing cross beams 300 formed to produce gaps 330*b*). Air 910 and moldable material 900 may move into the hollow chamber 340 of the cross beam through the gap 330*b* in addition to through the openings 320, thus improving internal air release during installation (see FIGS. 6*d-f*).

Figure 8:
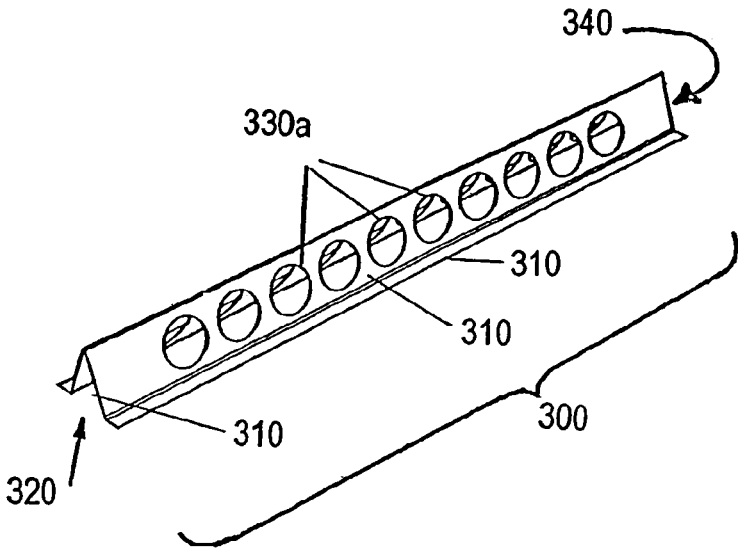
FIG. 8, shows a version of a cross beam 300 (similar in cross section to that depicted at FIG. 12*c*) having apertures 330*a* distributed along its length and noting the hollow channel 340 interior to the cross beam and in communication with an exterior via the two end openings 320 and the apertures 330*a;*

Aperture air release means 330*a*, like gaps 330*b*, also provide channels of communication between the hollow chamber 340 of each cross beam 300 and the exterior (see FIG. 8 and almost all other figures showing cross beams 300 for examples of apertures 330). Air 910 and moldable material 900 may move into the hollow chambers 340 of the cross beams 300 via the apertures 330*a* in addition to through the openings 320 and gaps 330*b* (when present) to greatly improve internal air release during installation (see FIGS. 6*a*-6*c*).

Figure 9:
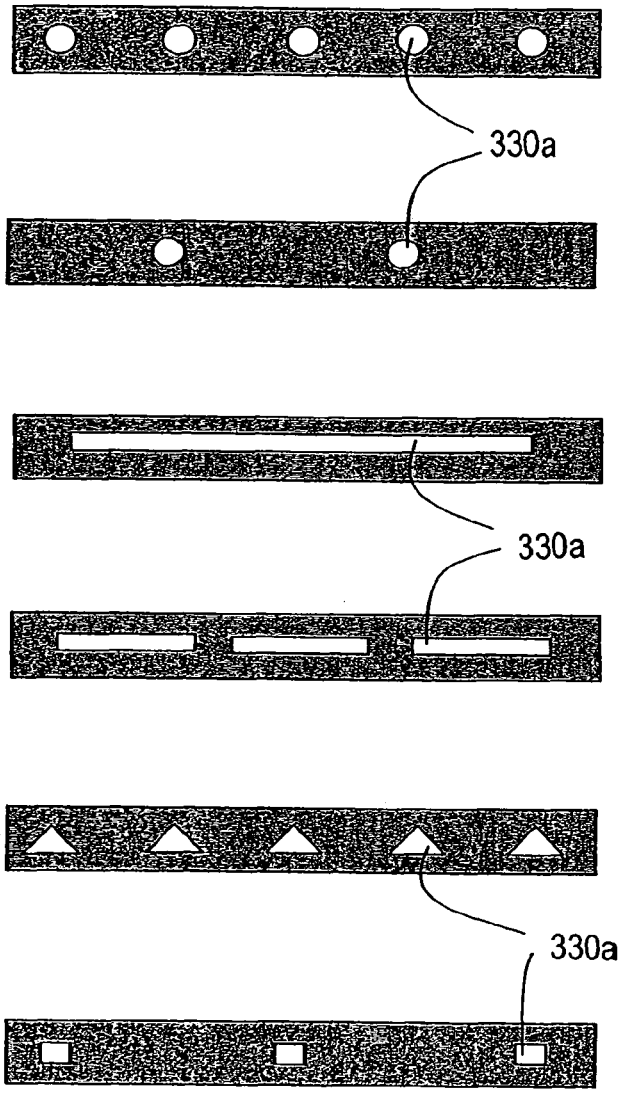
FIG. 9, shows side views of a cross beam 300 showing various possible versions of aperture 330*a* shape and distribution.
Figure 10A:
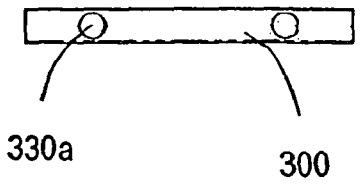
FIGS. 10*a* to 10*c*, show side view details of versions of cross beams 300 present in the embedment tile of FIGS. 1*b* and 5, which vary in length and in number of apertures 330*a;*
Figure 10B:
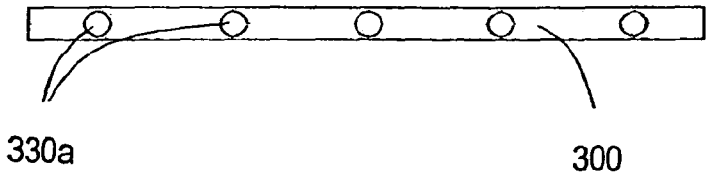
Figure 10C:
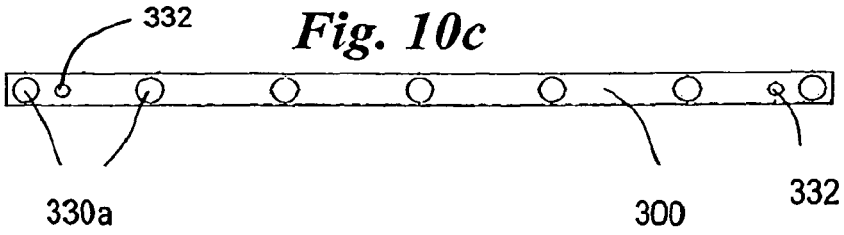

Aperture air release means 330*a*, though generally illustrated as circular openings, may be variously shaped (e.g., rectangular, saw-toothed, triangular, oval, square and the like) and variably distributed in the sidewalls 310 of cross beams (See FIG. 9 for examples). The number and size of the apertures 330 may vary with the depth and length of the cross beam 300. Several cross beams 300 of varying lengths are depicted in FIGS. 10*a*-10*c* in side view. In these versions, as length increases, so do the number of apertures 330, though the number and distribution of apertures 330 may vary and are not necessarily proportional to length of the cross beam 300.

In versions with apertures 330*a* and/or gaps 330*b*, some moldable material 900, in addition to air 910, also flows into the interior hollow chambers 340 of the cross beams 300. This tends to strengthen contact between the surrounding matrix and the cross beams 300 and interlock the beams 300 with the walkway when the moldable material sets and hardens. This results in excellent securement of the tile 100. The resultant release of air pockets 910 into the interior hollow channels 340 of the cross beams also removes their restriction to the movement of moldable material 900, thus enhancing its flow up toward the lower surface of the tile member 200 to more completely fill the areas between the cross beams 300. The resultant substantially complete filling of the underside of the tile member 200 with moldable material 900 further strengthens the tile 100 once installed in a walkway or the like.

The cross beams 300 themselves may vary in size and shape. For example, the depth 360 of the cross beam 300 may typically vary between 2.0 inches (5.1 cm) to 2.5 inches (6.3 cm). However, many other depths 360 are possible depending on the particular application. Likewise, cross beam lengths may vary.

Figure 11A:
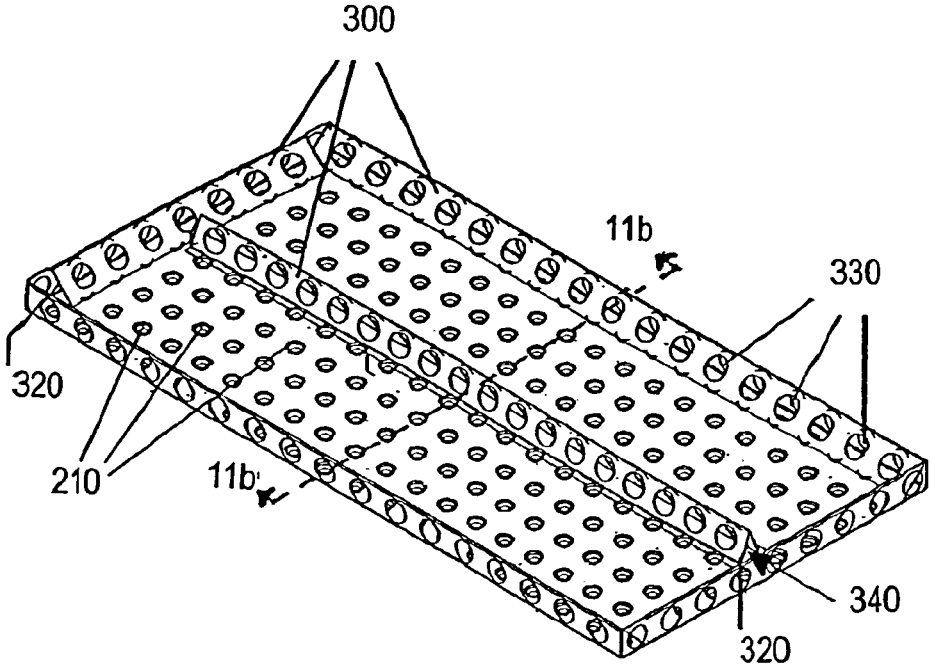
FIG. 11*a*, shows a bottom perspective view of a version of the embedment tile 100 of the present invention showing cross beams 300 extending down from each edge of the tile member 200 (similar in cross section to that depicted in FIG. 12*a*) and a central cross beam 300 (similar in cross section to that depicted in FIG. 12*c*)
Figure 11B:
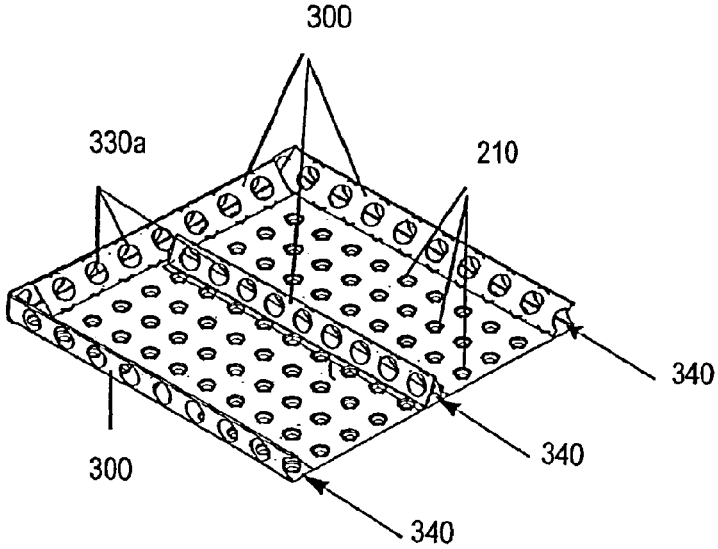
FIG. 11*b*, shows the bottom perspective view of FIG. 11*a* cut in cross section as indicated.
Figure 11C:
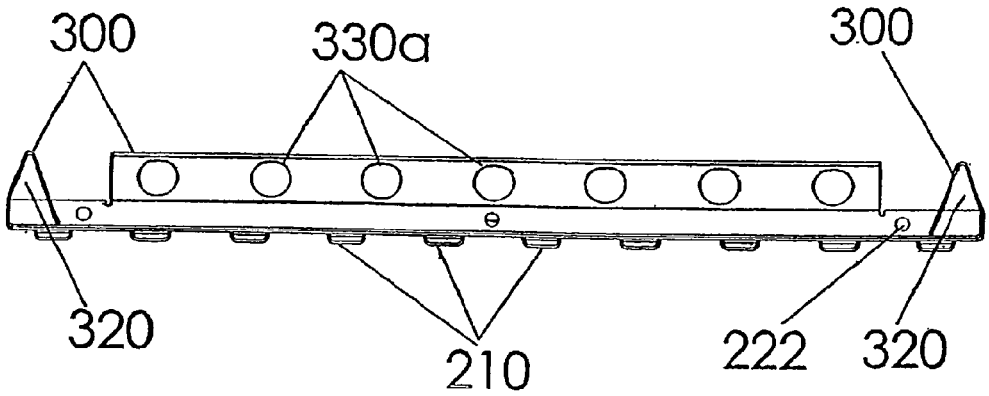
FIG. 11*c*, shows an end view of the embedment tile of FIG. 11*a*, showing details of the edge cross beams 300.

The cross beams 300 may be distributed on the lower surface of the tile member 200 in various ways. As depicted in FIG. 5, two longer cross beams 300 (detailed in FIG. 10*c*) are located length wise toward the outer edges of the lower surface of the tile member 200. Two cross beams 300 of shorter length (detailed in FIG. 10*a*) are located at opposite ends of the lower surface of the tile member 200 so as to span the distance between and to rest perpendicularly to the two longer beams 300. A fifth cross beam 300 (detailed in FIG. 10*b*) is located lengthwise down the middle of the lower surface of the tile member 200 in parallel to and midway between the two longer cross beams 300, and spanning the distance between the two short cross beams 300 running perpendicular to them. Other orientations (such as diagonal) and numbers of cross beams 300 may be employed also. As shown in FIG. 7*a*, cross beams 300 are distributed only at each side edge of the tile member 200. In FIG. 11*a*, edge cross beams 300 like in FIG. 7*a* are present with addition of a central cross beam 300 running substantially the entire length of the middle of the tile member 200.

Figure 12A:
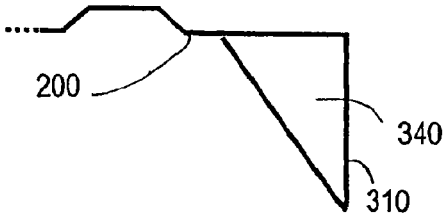
FIG. 12*a*-12*f*, show cross sectional views of several versions of the cross beams 300 of the present invention, FIGS. 12*a* and 12*b* of the type in which a gap 330*b* is formed when one side edge of the cross beam approaches but does not meet the lower surface of the tile member 200.
Figure 12B:
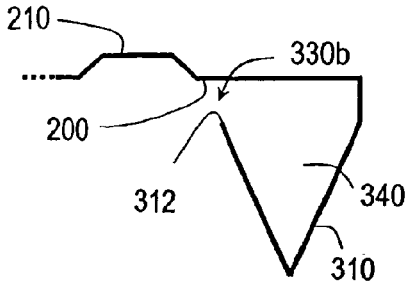
Figure 12C:
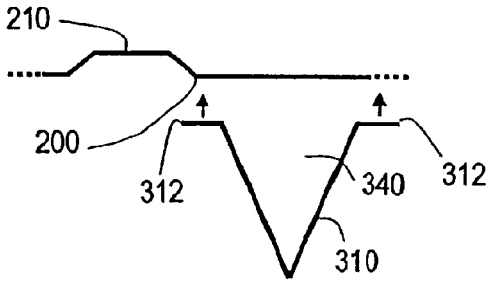
Figure 12D:
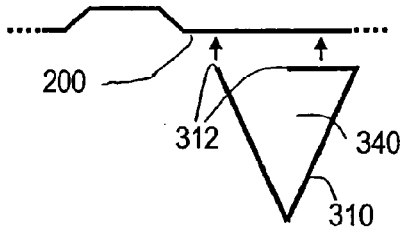
Figure 12E:
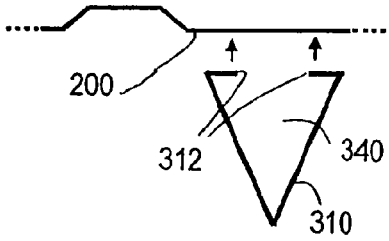
Figure 12F:
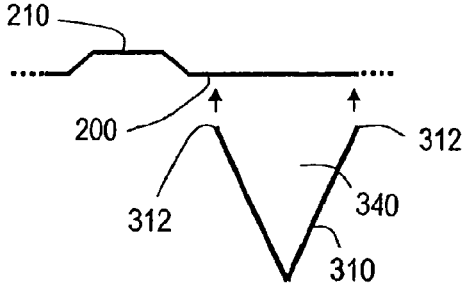

Cross beams 300 may likewise connect to the lower surface of the tile member 200 in various ways (see FIGS. 12*a*-12*f*). FIGS. 12*a* and 12*b* show connection of one side edge 312 of the sidewall 310 only so as to form the gap 330*b* where the opposite side edge of the sidewall approaches the lower surface of the tile member 200, but does not quite meet. The connection in these cases may be made by a simple bend in the tile member, with subsequent bends in the thus-defined sidewall portion 310 of the cross beams to define its 3-dimensional structure and hollow chamber 340 within. FIGS. 12*c*-12*f* show alternative formations of the sidewall 310 so that both edges 312, or portions of the sidewall proximate the edges, connect to the lower surface of the tile member 200 (FIG. 8 shows perspective view of FIG. 12*c* version). Connection in these cases may be made in a variety of ways such as by welding in the case of metal cross beams.

Figure 13:
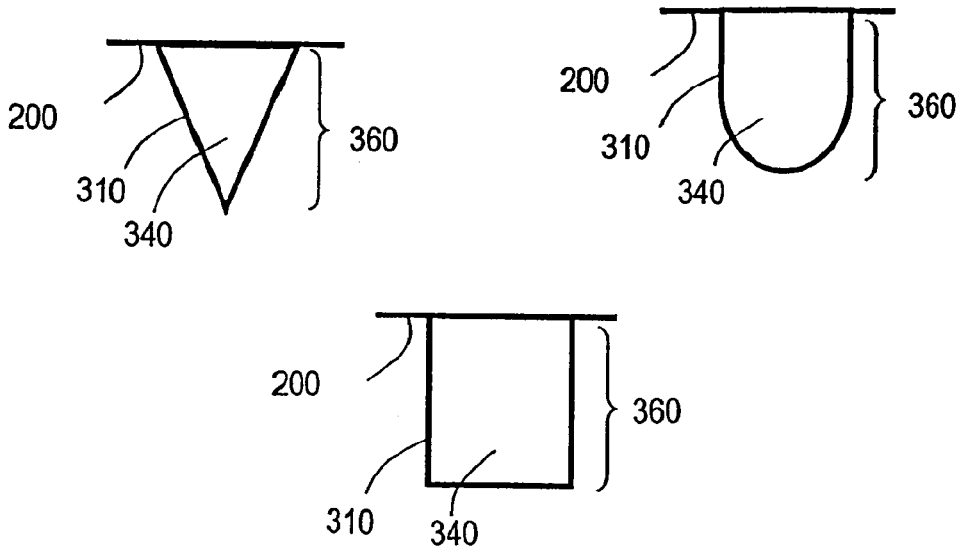
FIG. 13, shows cross-sectional views of versions of the cross beams 300 which vary in shape of the side wall 310.

Likewise, the shaping of the sidewall 310 may vary (see FIG. 13 for cross-sectional views depicting various shapes). The sidewalls 310 of the cross beams 300 may be shaped so that the cross beams are substantially V-shaped in cross section as in the version depicted in most of the figures. The V-shape functions well to enable the cross beams 300 to embed efficiently in wet moldable material 900 such as concrete or asphalt, acting to move the moldable material 900 into and around the cross beams 300 and to provide the interior cavity (i.e., hollow chamber 340) into which air 910 trapped under the tile member 200 may escape so as to enable insertion (as shown in FIGS. 6*a*-6*f*). However, as mentioned previously, the sidewall 310 may be formed to other cross-sectional shapes as well that function likewise such as U-shaped, round, square or otherwise (see FIG. 13).

As can be seen from the above, cross beams 300 with their hollow chambers 340, function both to stabilize the tile member 200 and to provide good internal air release to enhance the flow of trapped air 910 and material 900 into (via the end openings 320, and apertures 330*a* and/or gaps 330*b*) and around the cross beams 300 toward the lower surface and sides of the tile member 200 as the tile 100 is lowered into the moldable material 900, thus easing the embedment tile 100 down into the material and thereby facilitating rapid embedment of the tile 100 (see FIGS. 6*a*-6*f*). In versions of the tile member 200 where the projections 210 on the upper surface are accompanied by matching indentations on the lower surface below (as illustrated in FIGS. 1*b*, 2*b*, 6*a*-6*f*), the cross beams 300 also function to move the material 900 into the indentations, minimizing voids therein and thereby further fortifying the projections 210 above against cracking and breaking from heavy equipment.

As mentioned previously, once the material 900 sets and hardens, the portions of same which flowed into the hollow chambers 340 of the cross beams 300 (via the end openings 320 and apertures 330*a* and/or gaps 330*b*) function to interlock the tile 100 with the hardened material 900. However, to further improve interlocking, reinforced steel bars (reinforcement bars or, re-bars, L-bars, tie-bars and the like) may optionally be employed. These are sometimes desired by designers to assist with unusual applications. The re-bars may be inserted through the or into the cross beam 300 and/or support beam 400 (see below) chambers 340/440, and/or the apertures 330*a*. In some versions of the cross beams 300, additional re-bar apertures 332 may be provided to enable more options for insertion of re-bars.

Figure 14A:
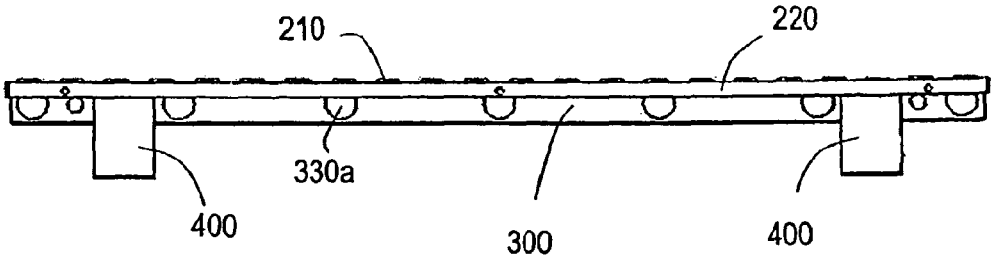
FIG. 14*a*, shows a side view of the embedment tile depicted in FIGS. 1*a* and 1*b;*
Figure 14B:
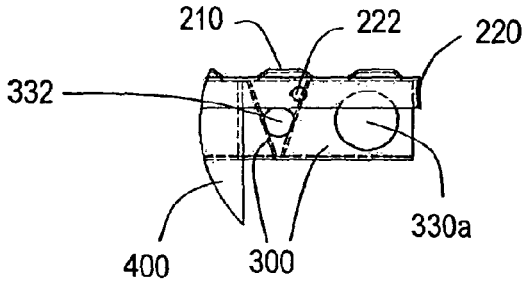
Figure 14C:
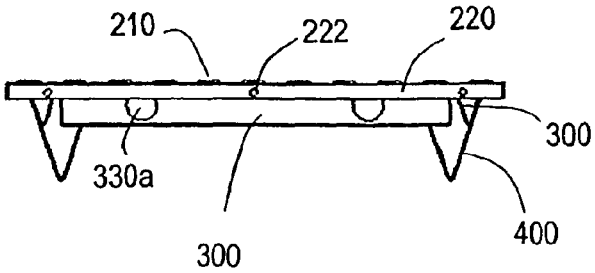
FIG. 14*c*, shows an end view of the embedment tile depicted in FIGS. 1*a* and 1*b;*

Referring to FIGS. 14*a*-*c*, detailed views of a version of the tile 100 of the present invention are shown [side view and enlargement of a portion thereof (FIGS. 14*a*,*b*), and end view (FIG. 14*c*]. In FIG. 14*b*, a detail of one version of cross beams 300 is shown with a re-bar aperture 332 located in one cross beam 300 so as to allow a reinforcement bar to be inserted at least partly there through and extend through an adjacent and perpendicularly oriented cross beam 300's hollow chamber 340. Many variations on orientation of air release apertures 330*a* and re-bar apertures 332 may be employed according to the needs of the user.

In some applications, tie-bars may be used to tie the tiles 100 to the surrounding concrete, particularly for tying narrow strips of concrete to the tile 100 and to keep tooled or untooled cracks (joints) from moving or offsetting. In general, tie-bars would extend through tooled in concrete joints in the sidewalk. The use of reinforced steel bars further stabilizes the embedment tile 100 and strengthens the interlocking between it and the concrete. Reinforcement bars may further aid in joining adjacent embedment tiles 100 to form larger areas of surface projections 210. Reinforcement bars may still further function in securing the embedment tile 100 in place during installation (see Method section below).

The embedment tile 100 may optionally further consist of two or more support members 400 (see FIGS. 1*b*, 5, 14*a*, 14*c*, 15) which function as support of the tile member 200 during installation. Support members 400 are attached to and project downward from the lower surface of the tile member 200 for a distance defining a depth 460 greater than the depth 360 of the two or more cross beams 300. The support members 400 may be two-dimensional and affixed perpendicularly in orientation to the lower surface of the tile member 200. Alternatively, the support members 400 may be three-dimensional constructs similar to the cross beams 300, but shorter in length as depicted in the figures referenced above.

In their three-dimensional version, support members 400 consist of a sidewall 410 having two opposing ends which define a length there between. The sidewall 410 is shaped so as to define a hollow channel 440 extending the length and an opening 420 at each end, the channel 440 being in communication with the exterior via the openings 420. In this way materials 900 may be displaced around and into the openings 420 as the embedment tile 100 is embedded in the concrete (similarly to how the cross beams 300 function). Thus an interlocking function is provided by the support members 400 once the moldable material 900 hardens in and around them, helping to further secure the tile 100 in the material 900 when it hardens.

Figure 15:
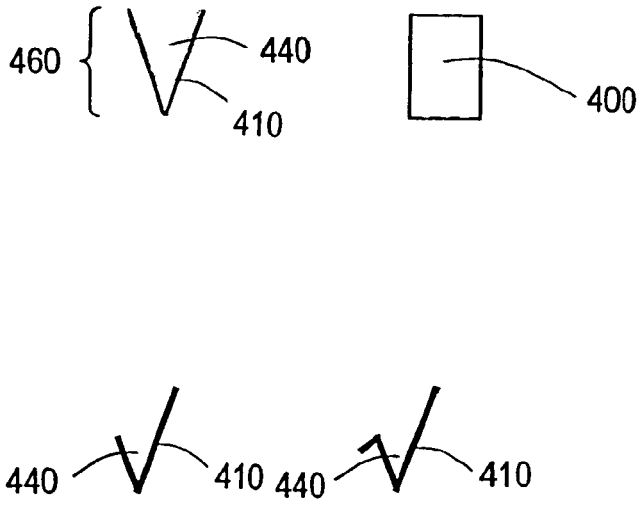
FIG. 15, shows a side view and several cross sectional views of versions of the support member 400.

Note that the support member sidewall 410 may assume various shapes in cross section similarly to those of the cross beams 300. Referring to FIG. 15, the sidewall 410 in a substantially V-format is shown. As can be seen, it may be bent to open the chamber 440 to the exterior along its length as in the two lower cross-sectional views. These more open versions may facilitate bending in circumstances where users must fit the embedment tiles 100 in odd places and positions relative to other objects, affording the user flexibility in how they may manipulate the support members 400.

As mentioned above, the support members 400 project downward from the lower surface of the tile member 200 for a depth 460 greater than the depth 360 of the two or more cross beams 300. By so doing, the support members 400 may further function to hold the tile member 200 at the appropriate level above the sub-layer of the walkway (e.g. at the surface height of the walkway) during pouring operations thereby providing an area for the moldable material 900 to flow around and underneath (see descriptions in method section of this alternative method of installation). This enables a user to install the tile 100 quickly into material 900 such as fresh concrete and to work from the surface of the tile member 200 to finish around the embedment tile 100 as necessary. Concrete finishing operations can continue without delay when using the embedment tile 100 with support members 400 attached.

Figure 16:
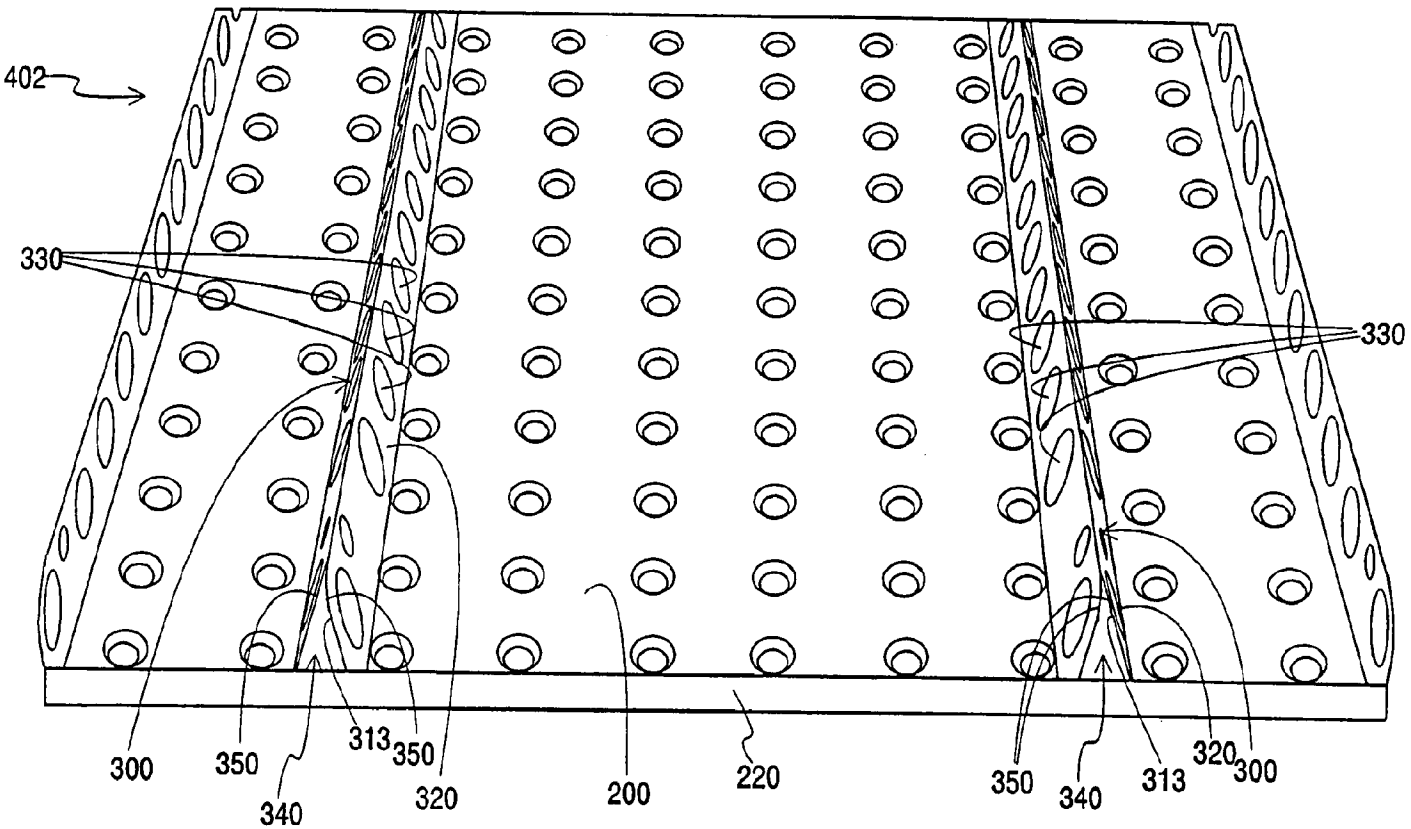
FIG. 16 is a partial perspective view of the underside of an alternate view of an embedment tile having cross beams with rounded ends and a lower beam end opening in accordance with the present invention.
Figure 17:
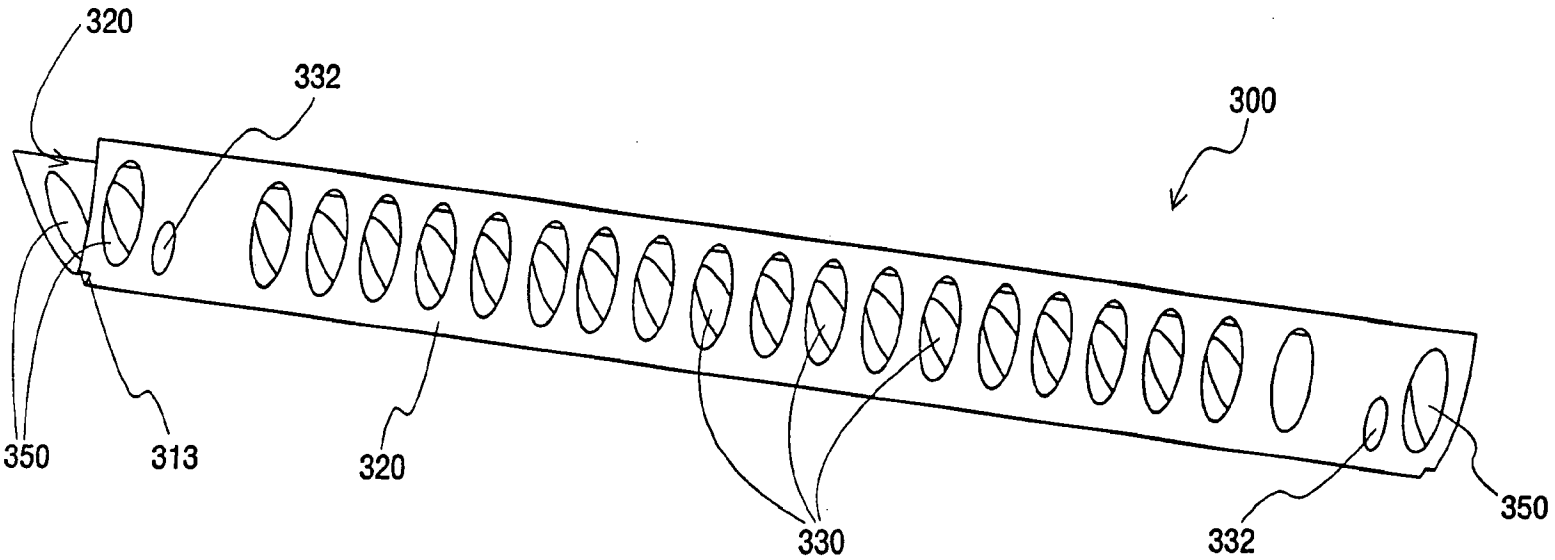
FIG. 17 is an isolated perspective view of the cross beam of FIG. 16.

FIG. 16 depicts an embedment tile 402 with a tile member 200, flanges 220, and at least one cross beam 300. The cross beams 300 have side walls 310, openings in the ends 320, and apertures 330 to define a substantially enclosed chamber 340. These parts are substantially the same as those described above, except that the ends 320 of the sidewalls 310 are not entirely perpendicular to the tile member 200.

Instead, the ends 320 of the cross beam 300 side walls 310 define downwardly facing edges 350 that are preferably tapered, and more preferably rounded down and inward to the bottom of the v-shape defined by the side walls 310 so that the end of the cross beam includes a lower open portion 313 through which moldable material can more easily enter the chamber 340. The illustrated taper is an arcuate portion 312 at the lower ends of the side walls 310. The arcuate portion 312 extends down and inward relative to the tile member 200. The edges 350 make it easier to embed the tile 200 into moldable material 900 such as concrete or asphalt by creating a slicing action that helps displace moldable material 900 while the tile 200 is being installed. Other shapes of edges 350 can be used, such as a straight taper, a stepped taper, and the like. The lower open portion 313 could even be at the bottom of a cross beam 300 without any end taper to provide a cross beam 300 in accordance with the present invention that is easier to install than a beam 300 with no lower open portion near the end. These lower openings permit moldable material to move into the chamber 340 more easily than an end that has no lower opening.

Holes 332 are smaller than openings 330 because the holes 332 are intended to have reinforcing steel bars extending through them for installations requiring such additional anchoring (in bridge decks or poured in place applications, for example) of the embedment tiles and/or reinforcement of the moldable material.

Holes 334 are defined by the tile member flanges 220 and can be used to match up and joined with an adjacent embedment tile with bolts or other connectors when it is desired to connect tile members 200 together before installation.

Figure 18:
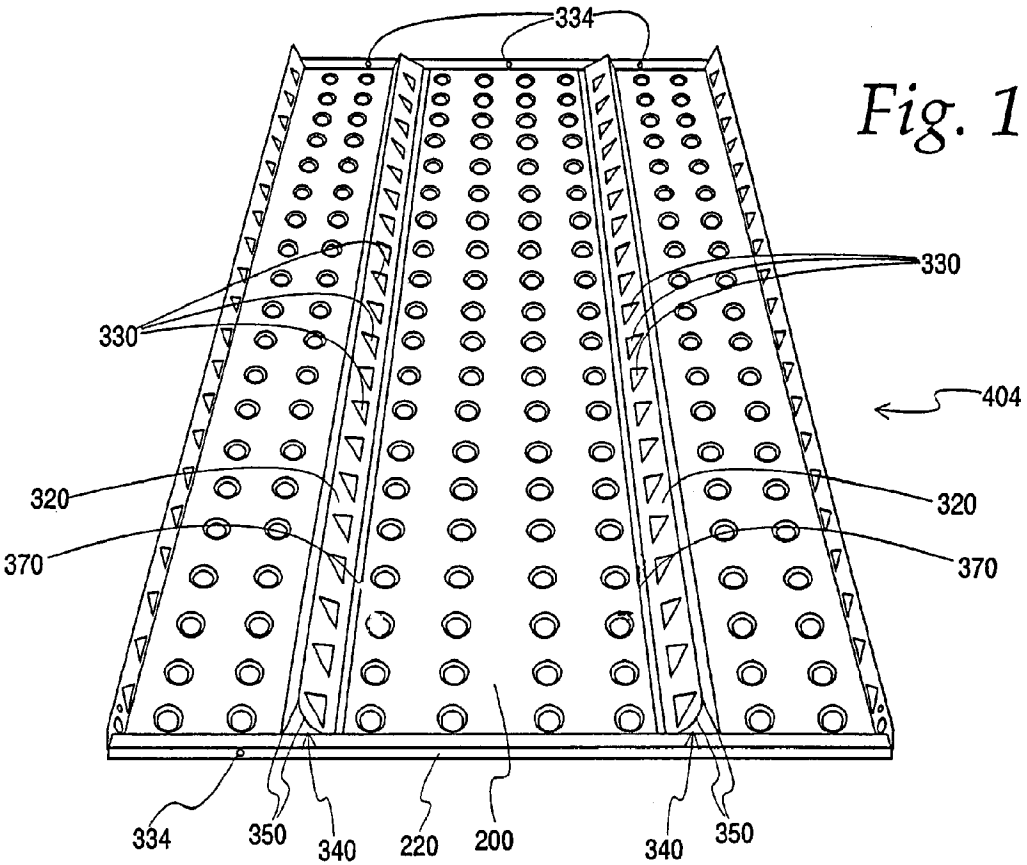
FIG. 18 is a perspective view of the underside of an alternate view of an embedment tile having cross beams with rounded ends, a lower beam opening, and adjacent reinforcing channels in accordance with the present invention.
Figure 19:
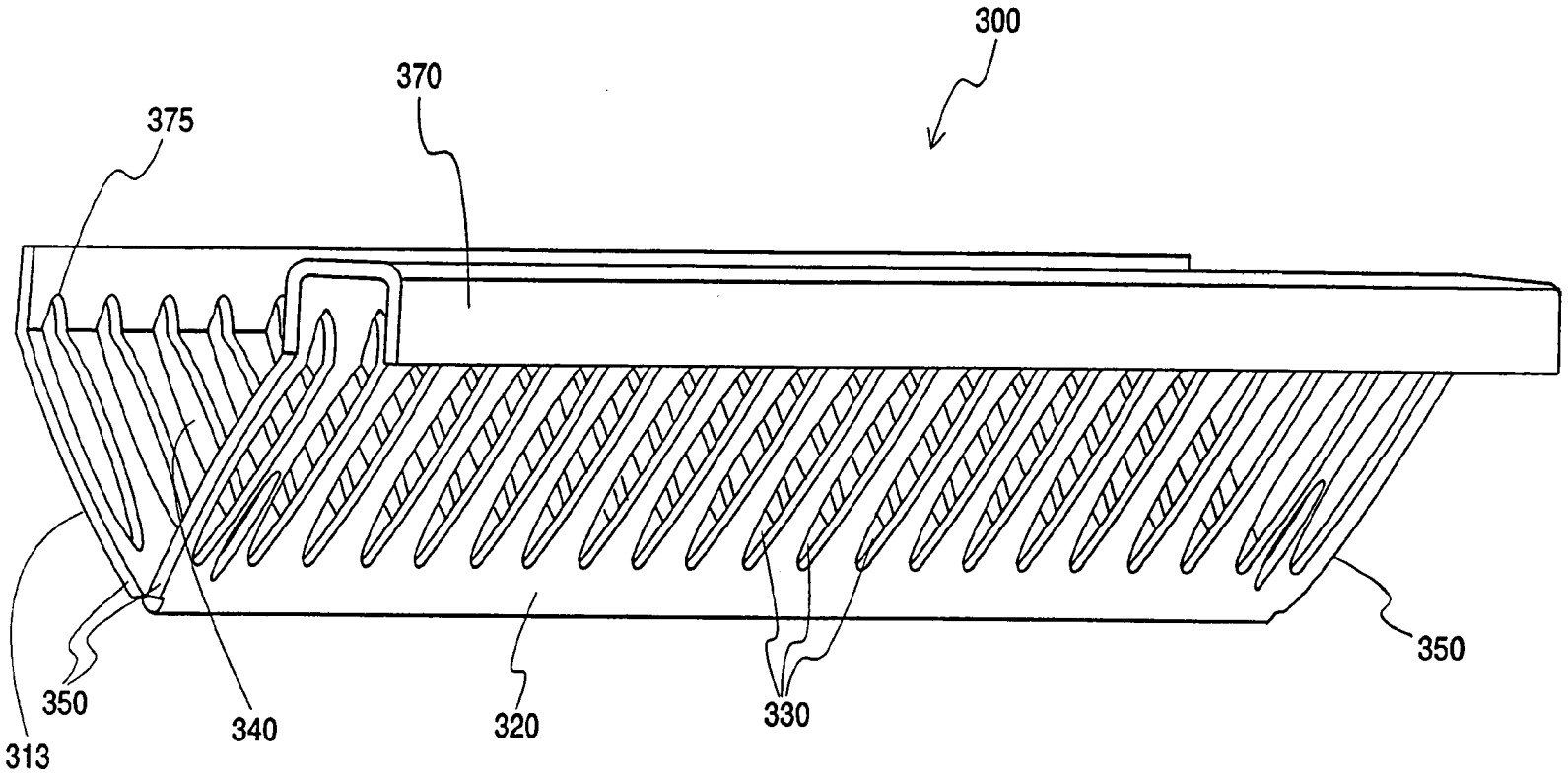
FIG. 19 is an isolated perspective view of the cross beam and reinforcing channel of FIG. 18.
Figure 20:
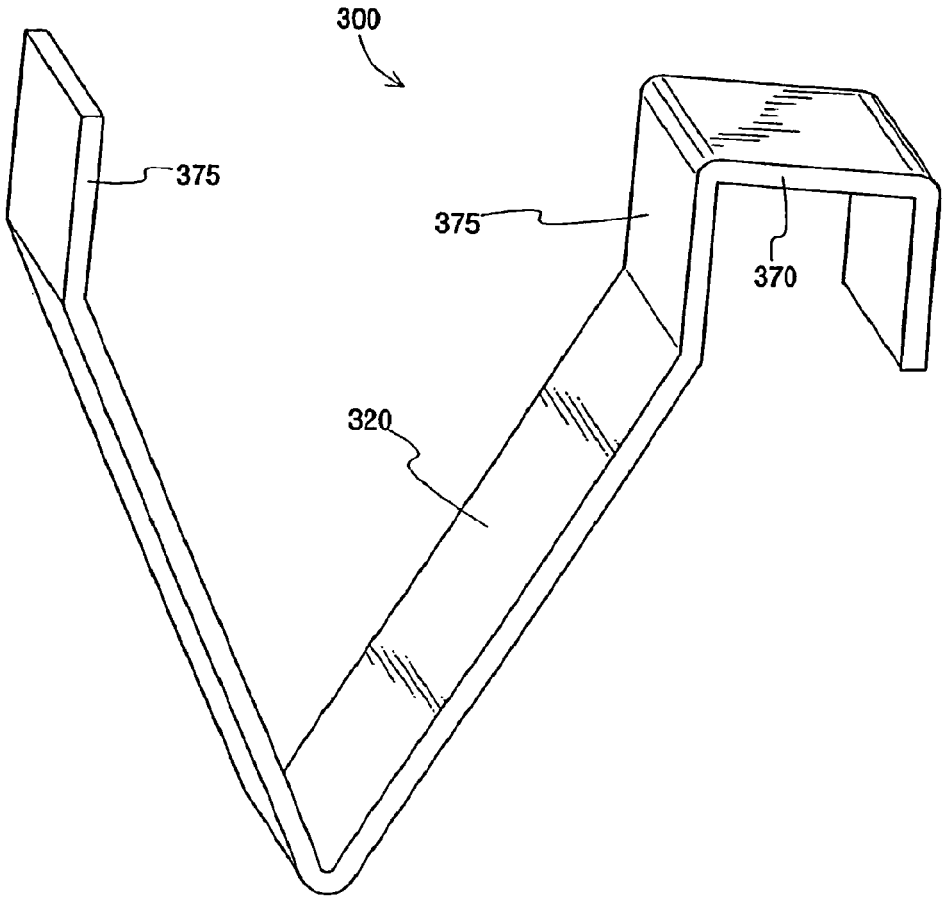
FIG. 20 is a partial perspective view of a cross-section of the cross beam of FIG. 18.

FIGS. 18, 19, and 20 illustrate yet another embodiment of an embedment tile 404 in accordance with the present invention. This embodiment includes a tile member 200 with flanges 220. In this embodiment, there are reinforcing members 370 in the form of channels. The reinforcing members 370 are preferred in some applications to make the tile member 200 more rigid during installation, and after installation if there happen to be any air gaps beneath the tile member 200. Although depicted as a channel, the reinforcing member 370 could be other shapes as well.

The reinforcing member 370 can be a separate element, but preferably, the reinforcing member 370 is formed integrally with the cross beam 300 for added strength and easier manufacturing. The cross beam 300 and reinforcing member 370 are also preferably made of rolled stainless steel, but other materials could be used. It is also possible to form the cross beam 300 and reinforcing member 370 separately, and connecting them with a weld, for example, before attachment to the underside of the tile member 200.

The reinforcing member 370 is preferably connected directly to the underside of the tile member 200 to provide optimum rigidity. This connection can be by welding, rivets, bolts, screws or any other type of connection.

In this embodiment, the cross beam 300 openings 330 are triangular in shape with their points directed downwardly. Such shapes may be desirable from a manufacturing standpoint, but any shape of opening 330 could be used. Preferably, when triangular shaped openings are used, they are oriented with their points directed upwardly (or opposite that shown in FIGS. 18, 21, and 22). Having the widest portion of the triangular opening in the lower portion of the cross beam 300 enables moldable material to flow into the chamber 340 more easily. This also reduces installation time.

As best seen in FIGS. 19 and 20, the cross section of the cross beam 300 is slightly different from the triangular shape described in earlier embodiments. In this embodiment, the cross beam 300 and reinforcing member 370 are formed integrally which results in the side walls 310 of the cross beam 300 including a portion 375 that is rolled to a more vertical shape. This shape can provide additional rigidity, especially when combined with the reinforcing members 370, as illustrated. Other shapes of cross beams 300 can be used in the present invention, as well.

Figure 21:
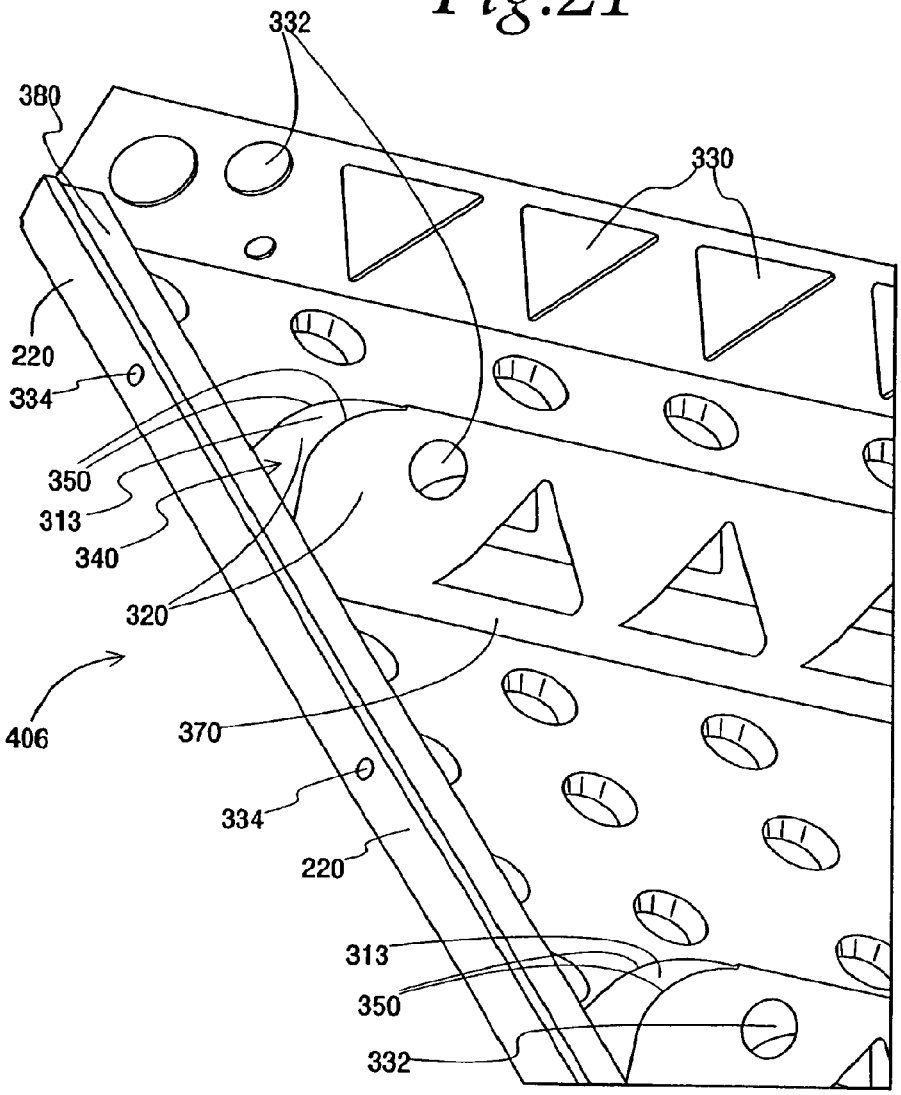
FIG. 21 is a perspective view of the underside of another alternate embodiment of an embedment tile having transverse reinforcing channels in accordance with the present invention.

FIGS. 20 and 21 illustrate a variation in the embedment tile 406 of the present invention. To provide additional rigidity, a transverse reinforcing member 380 is added adjacent to the edge of the tile member 200 even when a flange 220 is present. The transverse reinforcing member 380 is illustrated in the form of a channel for efficient penetration into the moldable material 900, but other shapes and sizes can be used in this embodiment of the present invention.

The transverse reinforcing members 380 preferably extend substantially the entire width of the tile member 200, but other lengths could be used as well. When the transverse reinforcing member 380 is used adjacent to a flange 220, the cross beam 300 is preferably cut short to provide space. This minor change in length of the cross beam does not significantly affect the embedment strength or rigidity of the cross beam 300.

Transverse reinforcing members 380 can be used at one edge of the tile member 200 only, or two can be used at opposite edges or any number can be used between the plate edges. When transverse reinforcing members 380 are used away from the edges of the tile member 200 they are preferably sized to fit between the cross beams 300.

Figure 22:
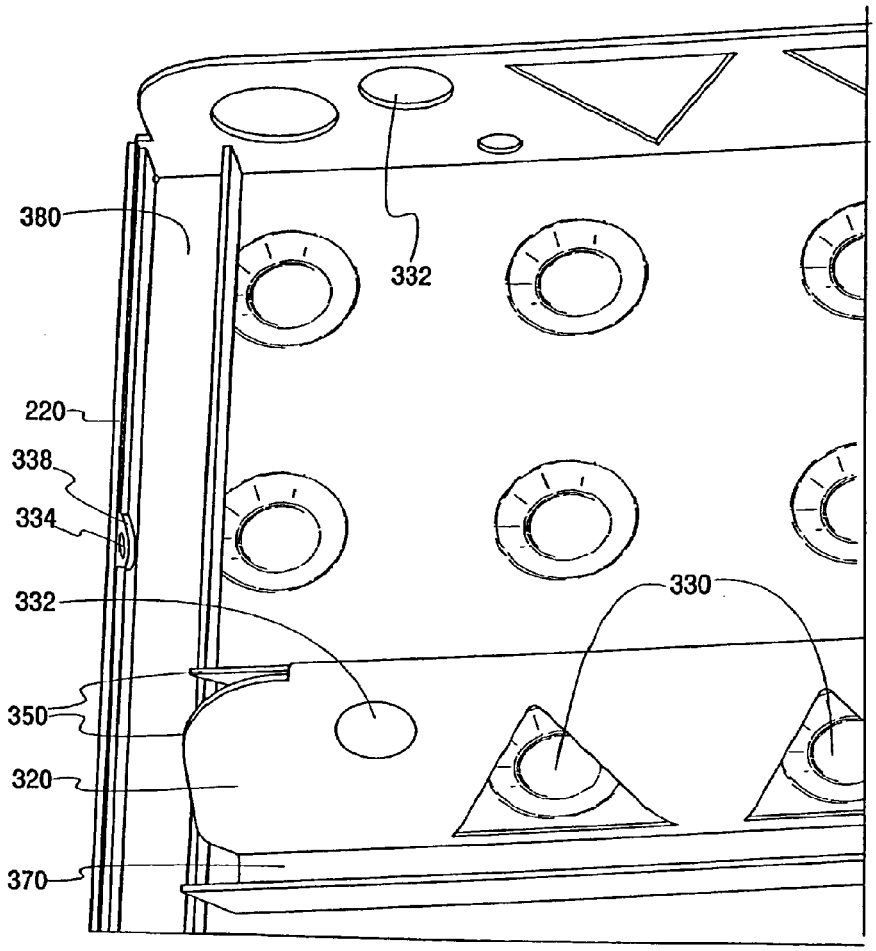
FIG. 22 is a partial perspective view of the underside of the embedment tile of FIG. 21.
Figure 23:
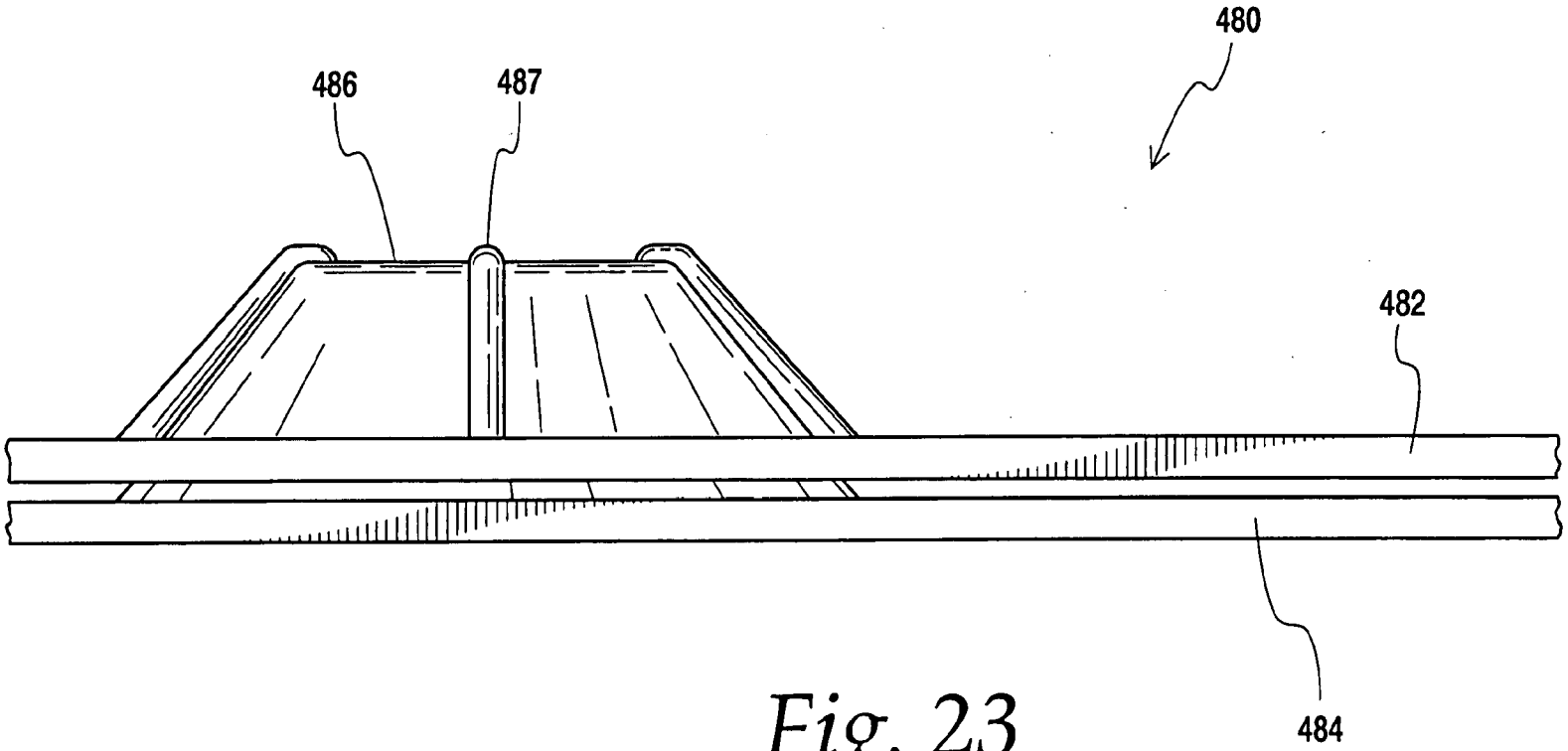
FIG. 23 is a side view of an upper plate and a lower plate in accordance with the present invention.
Figure 24:
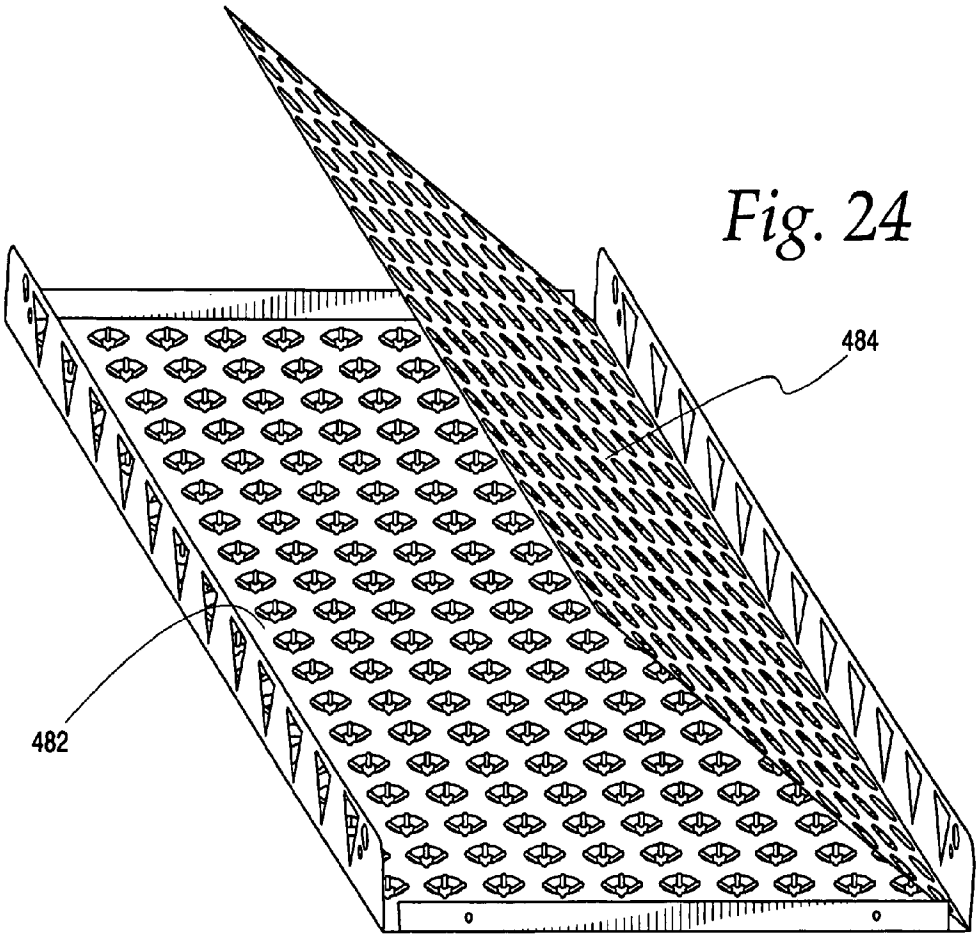
FIG. 24 is a perspective side view of the underside of a double plated embedment tile in accordance with the present invention, with the lower plate moved away from the upper plate.

When transverse reinforcing members 380 are used, they are preferably of a similar depth as the tile member flanges 220. To accommodate bolts through the bolt holes 334 for connecting adjacent embedment tiles, the transverse reinforcing members 380 include notches 338 that are aligned with the bolt holes 334 and are preferably oversized to accommodate nuts and washers. (FIG. 22).

Suitable materials for embedment tiles in accordance with the present invention include: plastic, composite materials, metal, coated metal, anodized or galvanized metal, cast iron, stainless steel (particularly grades 304 and 439 in a 16 gauge thickness) or any other suitable material.

The embedment tile 100 may be made in whole or in part, out of a variety of materials. Stainless steel has advantages of strength, durability and recyclability. However, the embedment tile 100 may be made out of other hard, durable materials such as galvanized steel, other metals, hard plastics, fiber reinforced plastics, resins and the like. As technology evolves, other types of metals, plastics, resins and the like may be developed that may be used to provide the durability needed in the tile member 200 and its projections 210, among other parts of the embedment tile 100.

One advantage of using stainless steel is that it is recyclable, thus conserving resources, and highly durable. Stainless steel will not be damaged by ultraviolet light, will not crack and will withstand heavy vehicle loading, e.g., snowplow equipment (including snow plows, end loaders, skid loaders) and heavy truck traffic across the domed area of the walkway. Unlike plastic dome projections 210 which experience all of the preceding types of damage, steel dome projections 210 will not sheer off when hit by snowplows and the like and will last as long as the concrete around them does. Maintenance of stainless steel embedment tiles 100 is, therefore, largely limited to periodically resurfacing an optional topcoat as necessary to maintain color contrast and skid resistance. The frequency and cost of maintenance over the long-term is thus minimized. The high durability of steel embedment tiles 100 ensures that the tactile-detectible surface is compliant with ADA requirements and that the surface is therefore, in condition to safely warn the blind and other users.

In those cases where ramped walkways, including the tactilely-detectable surface areas are removed from time to time for utility repairs or other necessary work, the embedment tile 100 can be removed for re-use again at the same site or other locations. This further reduces the costs of using the stainless steel version of the embedment tiles 100.

Detailed Description—Method

The various versions of the embedment tile 100 of the present invention may be embedded in fresh moldable material 900 in various ways. Following are descriptions of two basic methods, though others may be employed. The descriptions specify how to embed the tile 100 in fresh concrete. However, the basic methodology may be applied to other moldable materials 900 such as fresh asphalt.

The design of the embedment tile 100 enables installation to proceed easily and rapidly. For example, certain versions of the embedment tile 100 require only about 1 minute or less to install in concrete.

In general, the embedment tile 100 is either (a) embedded into already poured wet concrete (or other moldable material 900) or (b) is secured in place before the concrete is poured to fill in the walkway or other surface areas around and underneath the embedment tile 100. Once installed, the embedment tile 100 provides a pattern of projections 210 on its upper surface that remains exposed to pedestrian traffic once the concrete sets and hardens to provide a surface that is tactilely-detectable to pedestrians.

One version of the method for producing a tactilely detectable surface in concrete comprises providing a version of the embedment tile 100 described above for embedment in wet concrete. A user installs the embedment tile 100 by (a) lowering the embedment tile 100 into the concrete; and, (b) positioning the upper surface of the tile member 200 relative to a surface of the surrounding concrete as desired and so that the upper surface's tactilely-detectable pattern of projections 210 is exposed. A user may optionally work from the surface of embedment tile 100, finishing (and optionally also edging) around the two or more edges of the embedment tile 100. The concrete is then allowed to set and interlocking to occur between the embedment tile 100 and the hardened concrete.

Another version of the method for producing a tactilely detectable surface in concrete also comprises providing a version of the embedment tile 100 described above prior to pouring wet concrete. In this version however, a user installs the embedment tile 100 by (a) securing the embedment tile in place relative to an existing sub-base or newly prepared sub-base; (b) adjusting the embedment tile 100 to meet slope or grade requirements (e.g., those set by the ADA Accessibility Guidelines or other requirements of the user); and, (c) pouring the concrete onto the sub-base in a formed area and under and around the embedment tile 100. A user may work from the surface of embedment tile 100, working the concrete under and around the embedment tile 100 and finishing (and optionally also edging) around the two or more edges of the embedment tile 100. The concrete is then allowed to set and interlocking to occur between the embedment tile 100 and the hardened concrete. This version may further comprise using a concrete vibrator to consolidate the concrete.

Securing the embedment tile 100 in place may comprise (a) anchoring the embedment tile 100 to the sub-base, or (b) suspending the tile above the sub-base.

Anchoring the embedment tile 100 will generally involve resting the embedment tile 100 on the sub-base or a portion thereof [depending on version, it may rest on the sub-base (or shims placed on the sub-base) by its cross-beams 300 or by its support members 400]. Once resting in place, one or more weights (such as sand bags, cement blocks, or the like) may be placed directly on the upper surface of the embedment tile 100. Alternatively, L-shaped reinforcement bars (or, re-bars) may be placed through or into the bottom portions of hollow channels 440 of the support members 400 (or if resting on cross-beams 300, through the bottom portions of hollow chambers 340) and secured to the sub-base by pushing or tapping the reinforcement bars down into the sub-base. Likewise, other types of reinforcement bars and means for anchoring the embedment tile 100 may be employed.

Alternatively, securing the embedment tile 100 in place may consist of suspending the embedment tile 100 above the sub-base before the concrete is poured. In one version, the embedment tile 100 is suspended above the sub-base by placing L-shaped reinforcement bars (or, re-bars) into the hollow chambers 340 of the cross beams 300 or bar aperture's 332 of cross beams 300 and securing the other ends of the reinforcement bars into the sub-base by pushing or tapping the reinforcement bars down into the sub-base. Alternatively, suspending the embedment tile 100 may be accomplished by securing a wood board or other rigid material to the upper surface of the embedment tile 100, then resting ends of the wood board on an existing portion of concrete surface (such as a walkway and back of curb and gutter) to hold the embedment tile 100 to grade. Other alternatives for suspending the embedment tile 100 may also be employed.

Advantages of the Invention

The previously described versions of the present invention have many advantages, including:

providing an embedment tile with cross beams on its lower surface designed with hollow chambers, openings therein to enable air trapped under the tile during embedment to move into the hollow chambers the openings and further air release means, thus affecting internal air release and minimizing air pocket obstructions to the smooth movement of moldable material into and around the cross beams and toward the lower surface and sides during embedment of the tile;

means for providing tactilely detectable warning surfaces (or other surface patterns such as way-finder, decorative and the like) that are both efficiently installed and durable to enable entities to comply with ADA Accessibility Guidelines, or other requirements, rapidly and cost-effectively;

means for providing tactilely detectable surfaces in moldable materials such as concrete and asphalt efficiently and reliably so as to save installation time and labor costs;

means for providing tactilely detectable surfaces in moldable materials such as concrete and asphalt durably so as to minimize the need for replacement and thereby, the long-term costs of maintenance, by providing embedment tiles that last at least as long as the surrounding materials;

means for providing embedment tiles that are reusable in order to conserve materials and to minimize replacement costs; and, means for providing embedment tiles with improved recyclability so as to maximally conserve environmental resources.

The present invention does not require that all the advantageous features and all the advantages need to be incorporated into every embodiment thereof.

Depicted in FIGS. 23 to 27 is an embedment tile 480 with a replaceable top plate of the present invention, having a double plated surface, such that an upper plate 482 that is non-compliant, damaged, or requires replacement for any other reason can be easily removed, replaced, and secured with fasteners to a lower plate 484 of the embedment tile 480. The lower plate 484 and the upper plate 482 can both have raised conical domes 486 of similar size, spacing, and shape such that they nest and provide a strong embedment tile that resists damage better than a single plate surface of an embedment tile. As seen in FIG. 28, the lower plate 484 can have embossed domes 488 that are not ribbed because the domes without ribs are not exposed and are cheaper to manufacture, yet are able to nest with the embossed domes 486 of the upper plate 482, although the domes 488 could also have ribs 487 like those on the upper plate 482 domes 486.

Figure 25:
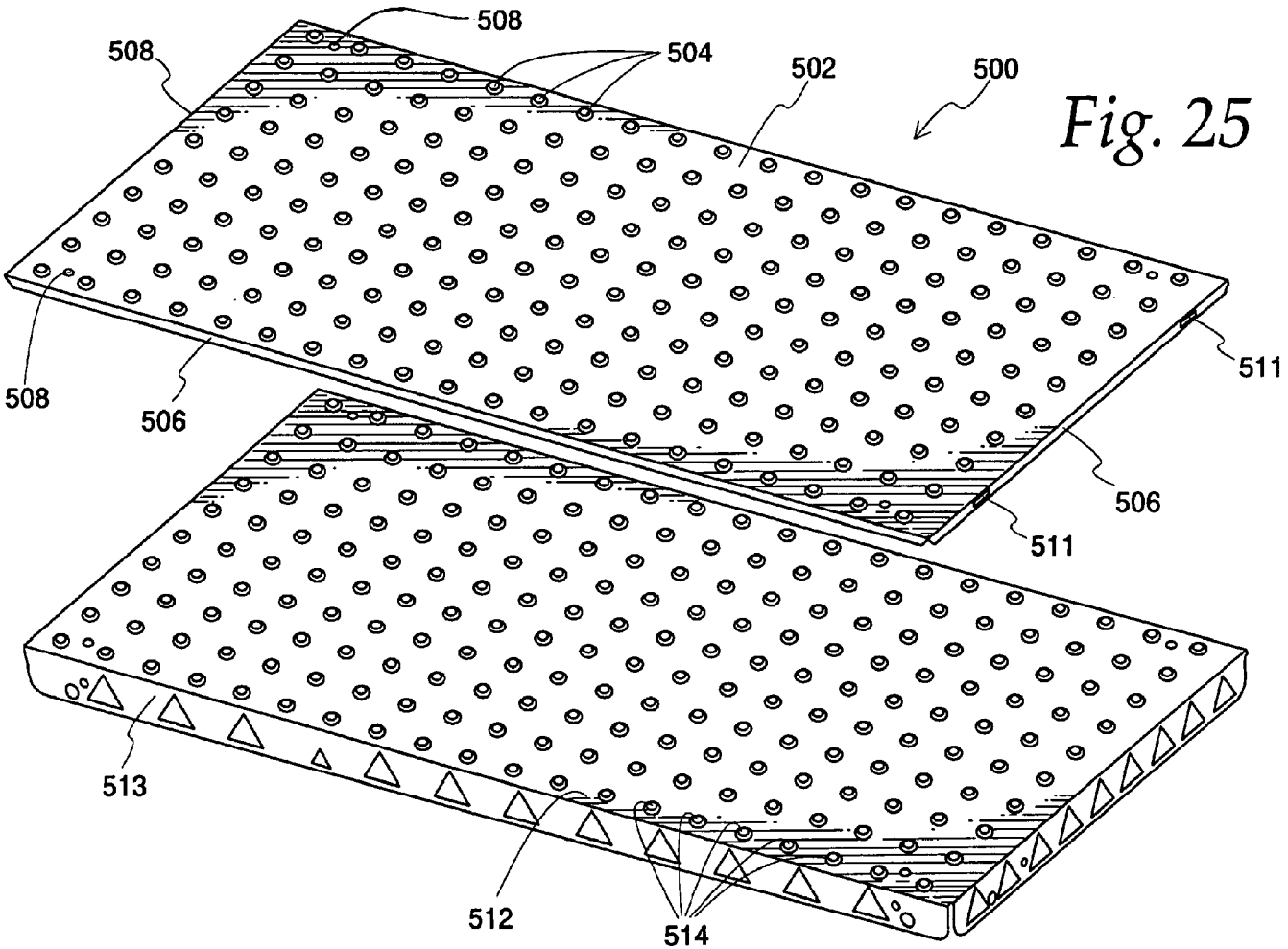
FIG. 25 is an exploded and perspective view of the top of an embedment tile in accordance with the present invention.
Figure 29:
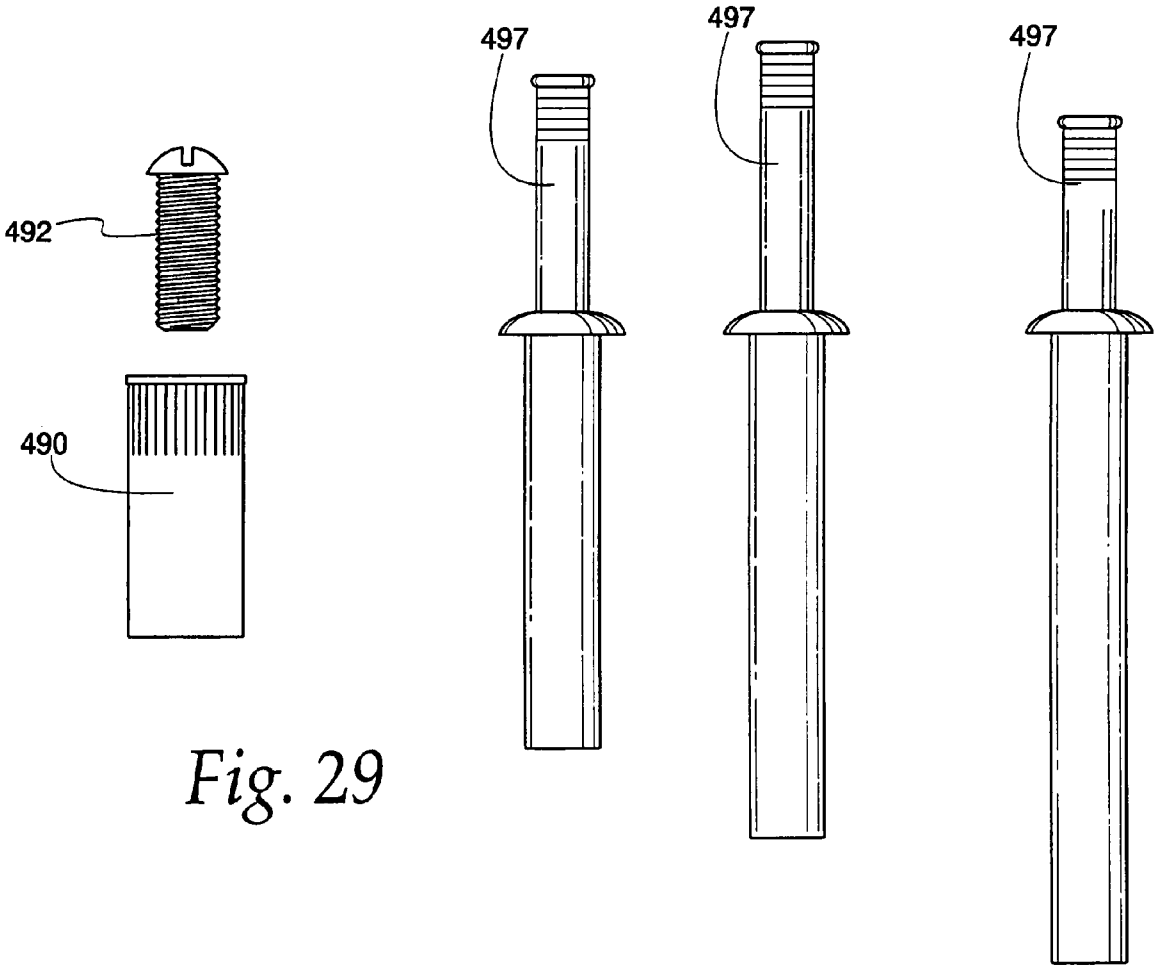
FIG. 29 is a side view of top plate fasteners and anchors for use in the embedment plate of the present invention.
Figure 30:
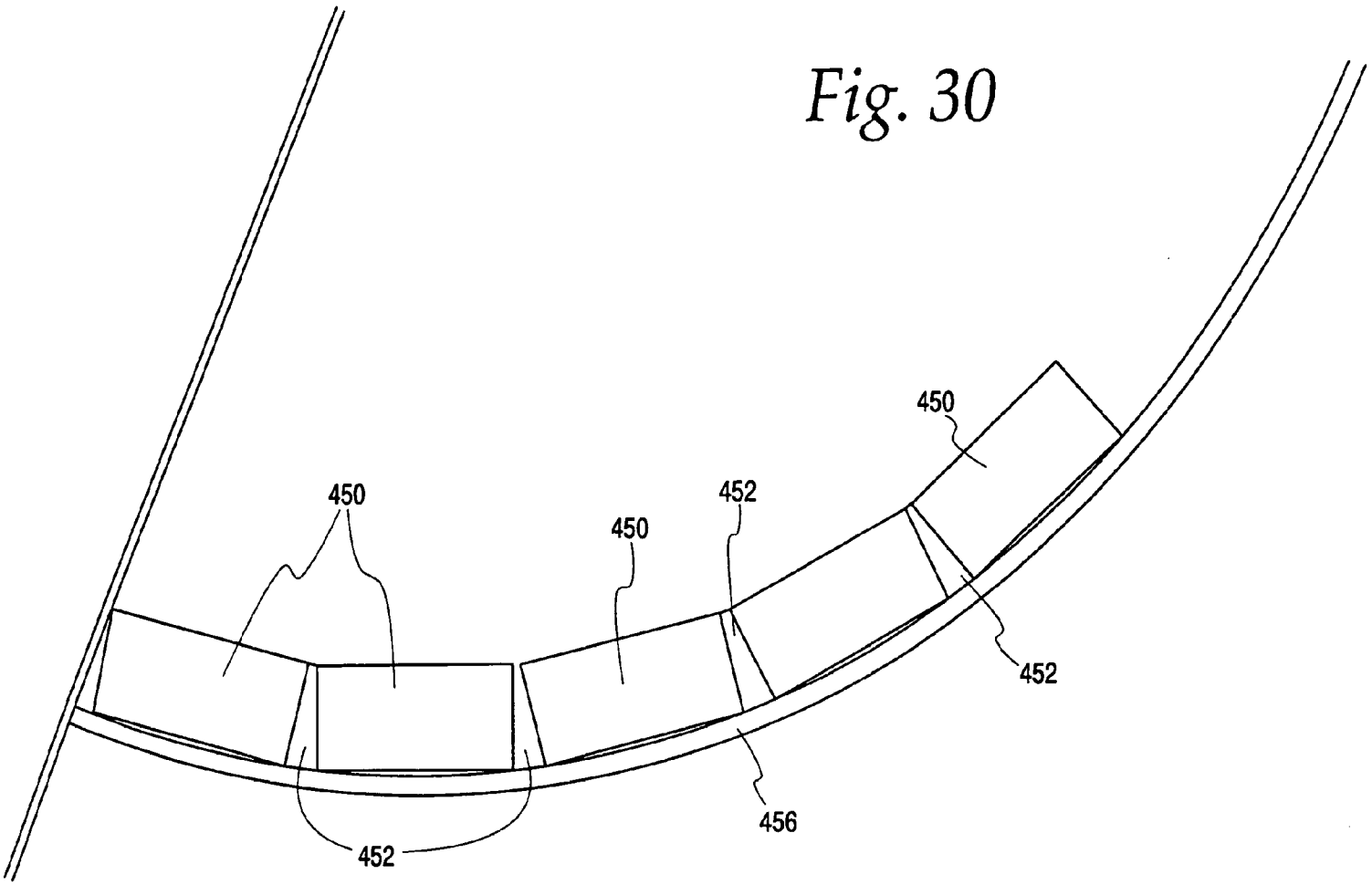
FIG. 30 is a top view of a plurality of wedge-shaped embedment tiles in accordance with the present invention.

The upper plate 482 and the lower plate 484 can be joined together by nuts 490 and bolts 492 (FIG. 30), and in particular can be joined with nuts 490 secured to the lower plate 484 and bolts 492 that extend through holes 508 (such as seen in FIG. 25) in the upper plate 492 and are threaded into the nuts 490. The nuts 490 are preferably closed at the bottom to prevent concrete and other debris from entering the nut 490 (FIG. 29).

The embedment tile 480 can be preassembled at a factory and initially installed in the same way a single plate embedment tile is installed, as described above. When the upper plate 482 requires replacement, the bolts 492 are removed, the upper plate 482 is removed, the new upper plate 482 is nested on top of the lower plate 484, and the bolts (or new bolts) 492 are threaded into nuts 490 attached to or anchored underneath the lower plate 484. Other types of anchoring systems can also be used to secure the upper plate 482, such as expandable anchors 497 (FIG. 29) that wedge into cured moldable material under the embedment tile.

Alternatively, the double plated embedment tile 480 can be initially installed with only the lower plate 484 and the upper plate 482 added after the lower plate 484 portion is embedded in moldable material and stabilized. Such an installment method reduces the overall weight of the embedment tile for ease of installation.

Further, with the upper plate 482 removed, the embedment tile lower plate 484 can include air vents 496 (FIG. 28) to allow air to escape from under the embedment tile 480 during installation. Air vents 496 are particularly useful in the conical domes 488 (as illustrated) of the lower plate 484 because they allow air pockets under the domes 488 to escape and moldable material to fill the undersides of the domes 488 to reinforce the domes 488 from snow plow damage, for example.

Figure 26:
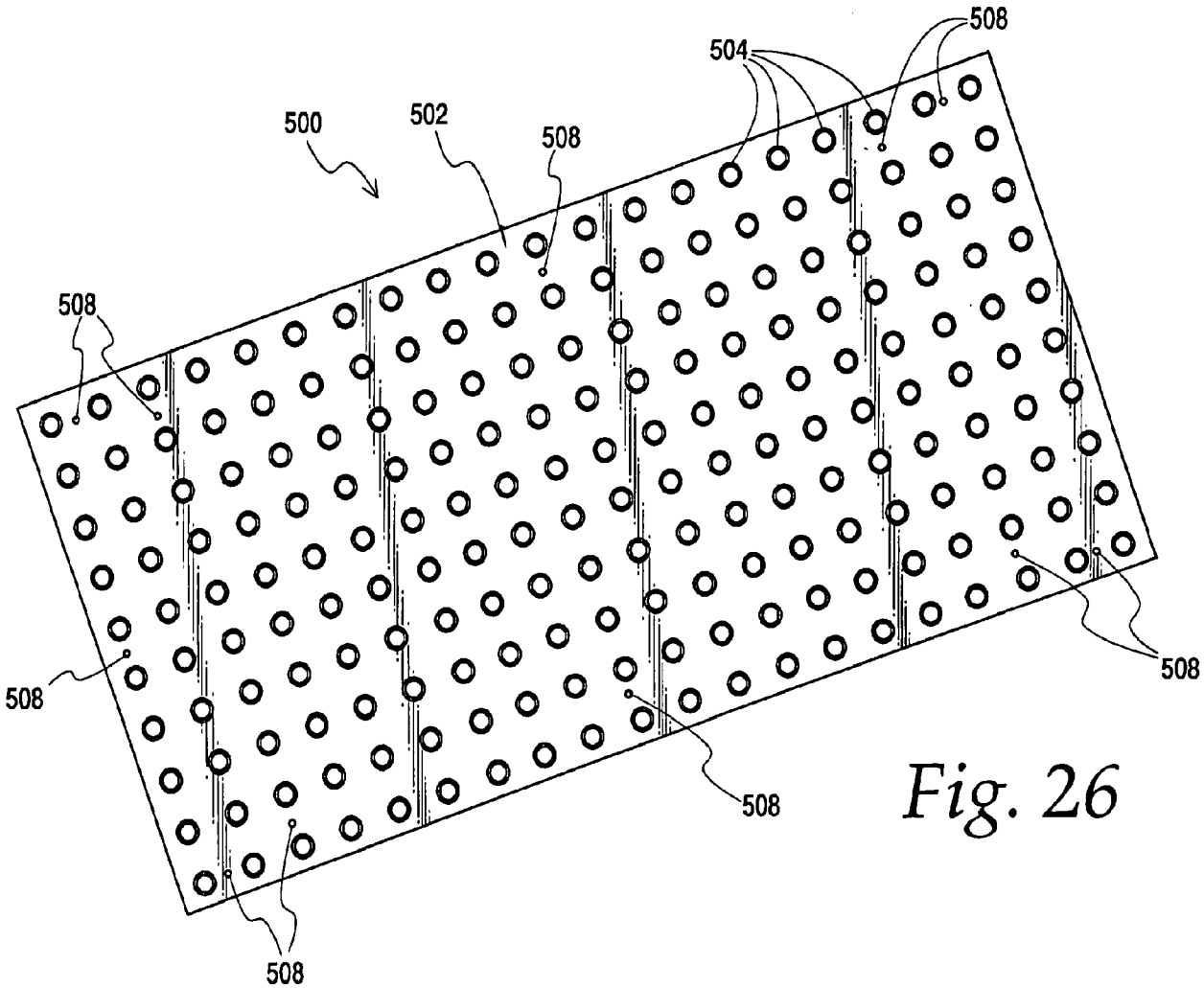
FIG. 26 is a top view of the embedment tile replaceable top plate in accordance with the present invention.
Figure 27:
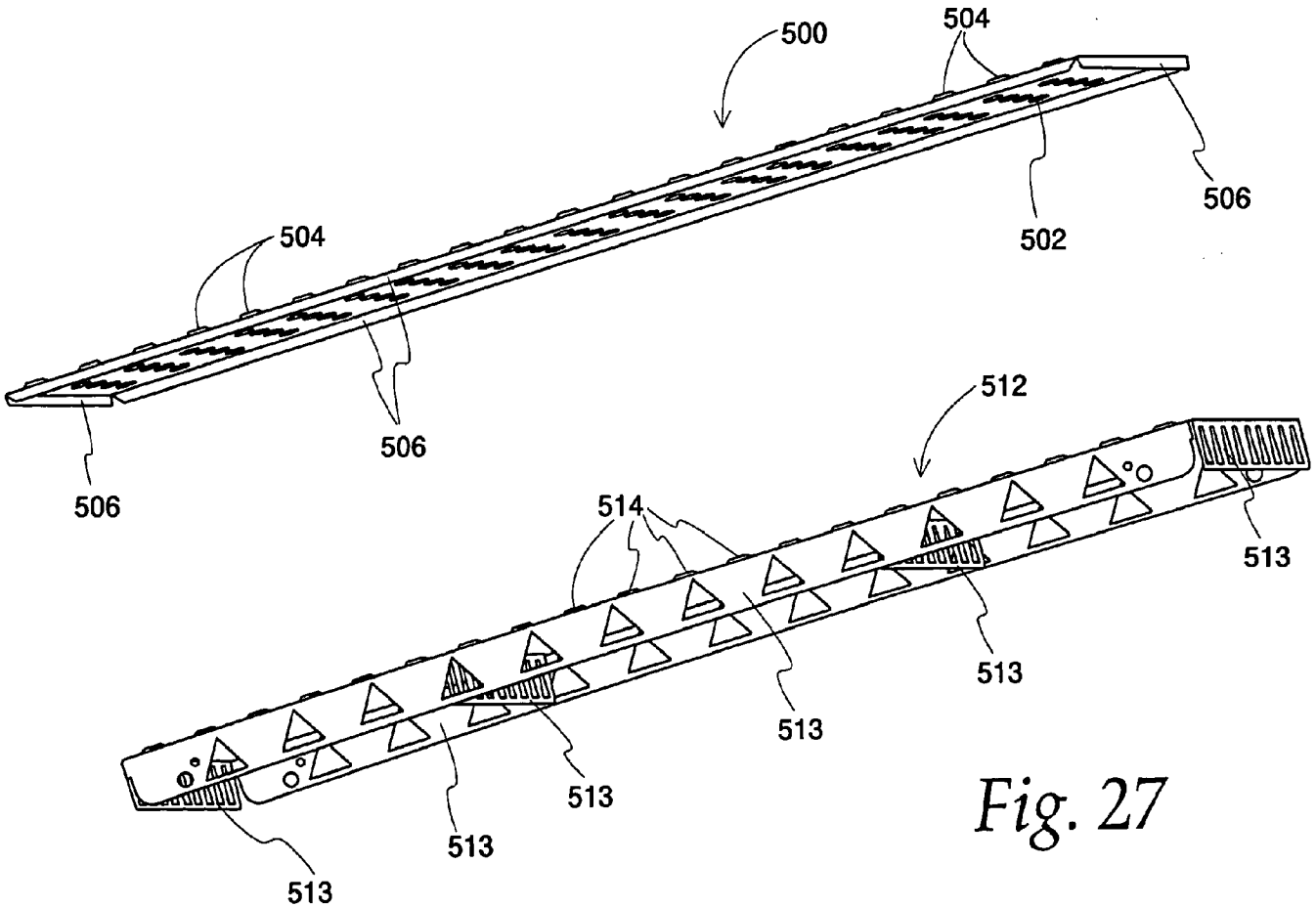
FIG. 27 is an exploded and perspective view of a bottom of the embedment tile of FIG. 25 in accordance with the present invention.
Figure 28:
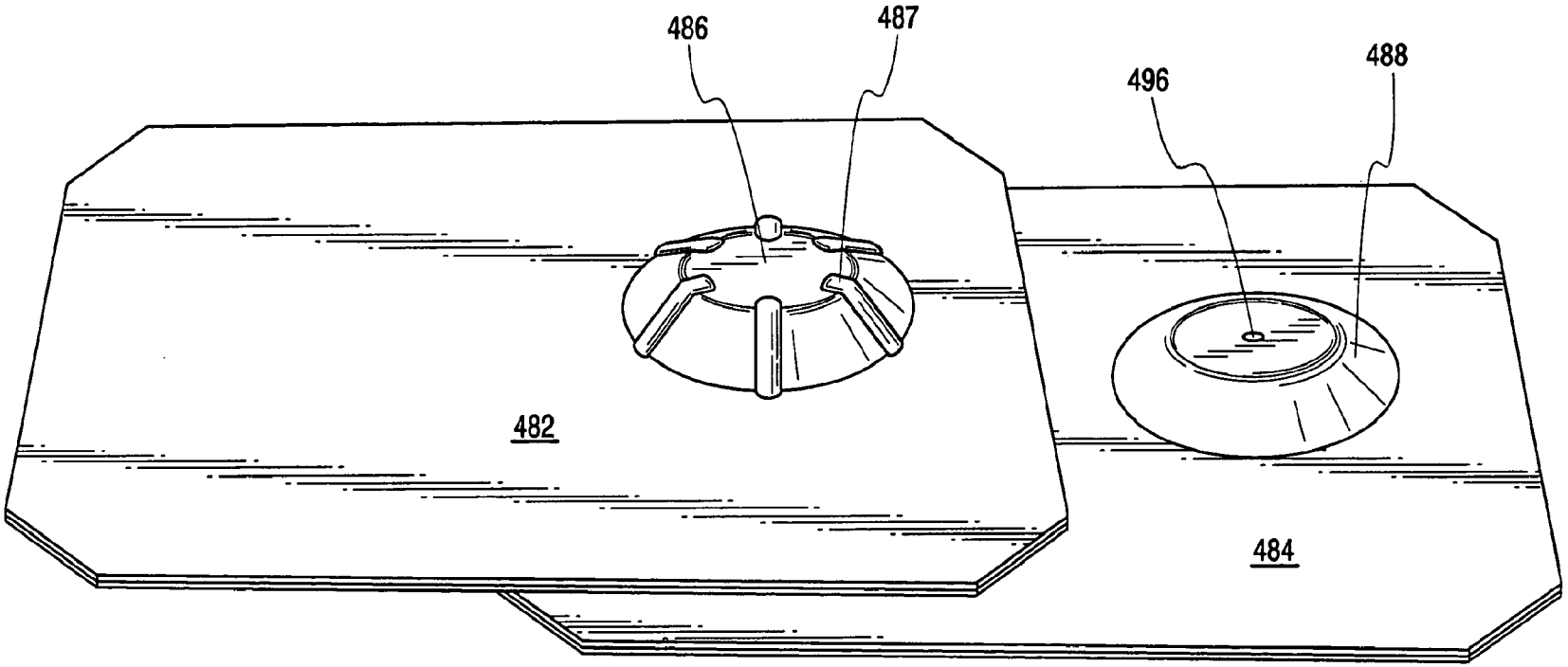
FIG. 28 is a perspective view of a portion of a top plate and a portion of a bottom plate for an embedment tile in accordance with the present invention.

FIGS. 25, 26, and 27 depict another embodiment of an embedment tile 500 in accordance with the present invention. The embedment tile 500 includes an upper plate 502, a number of tactile projections 504, downwardly extending flanges 506, and anchor holes 508. The embedment tile upper plate 502 is positioned over a lower embedment tile plate 512.

The upper plate 502 of this and the other embodiments can be made of any suitable material, but is preferably stainless steel of at least 16 gauge, Grade 304. The upper plate 502 (and 482 above) can also be E-coated and painted for a durable coating.

The lower plate 512 (and 482 above) need not be made of stainless steel because it is not as exposed to damage as is the upper plate 502 (and 484). Nonetheless, the lower plate 512/482 can be any suitable material such as stainless steel, galvannealed steel or mild steel, and any of these can be E-coated for added corrosion resistance. A coating weight of A60 of galvannealing provides adequate protection from snow plow damage, but other weights may be used depending upon subsequent manufacturing steps and expected product usage.

The tactile projections 504 are shaped to meet or exceed all state and federal design requirements for such tactile surfaces, as explained above in relation to the embedment plates. Preferably, the tactile projections 504 are sized and spaced so that the embedment tile top plate 500 nests onto the lower plate 512. Alternatively, the embedment tile top plate 500 can rest on top of the lower plate 512 projections 514.

The downwardly extending flanges 506 preferably extend down about 0.500 inches and are formed integrally with the plate 502. The downwardly extending flanges 506 preferably include slots 511 that function to permit flexibility during installation. The downwardly extending flanges 506 can be a single flange that either completely or only partially surrounds the embedment tile upper plate 500 plate 502.

The anchor holes 508 are preferably formed during manufacture of the embedment tile upper plate 500 by stamping, punching, drilling or other method, but they can be drilled on site where the embedment tile upper plate 500 is to be installed.

Also preferably, the embedment tile upper plate 502 is sized to match the size of the lower plate 502, but this is not absolutely necessary because the embedment tile upper plate 502 can be larger or even smaller than the embedment tile lower plate 512. The embedment tile lower plate 512 can include any type of moldable material anchor 513, with those described above in other embodiments being preferred.

A method for installing a embedment tile upper plate 500 in accordance with the present invention includes the steps of; forming a flange recess at least partially around a lower plate 512, placing a embedment tile upper plate 500 over the lower plate 512, inserting a downwardly extending flange 506 into the flange recess, and anchoring the embedment tile upper plate 500 to cured concrete or asphalt underneath the lower plate 512.

The step of forming a flange recess can include sawing a recess around or at least partially around the lower plate 512. The step of anchoring the embedment tile top plate 500 to the cured moldable material underneath the lower plate 512 can include the steps of drilling holes into the cured moldable material and inserting anchors in the holes. Preferably, the anchors include an AVK nut that is enclosed at its bottom end that is pounded into a drilled hole and a bolt 492 that is threaded into the AVK nut 490. Other anchor types can also be used. AVK fasteners are available from AVK Industrial Products located at 25323 Rye Canyon Road, Valencia, Calif. 91355.

FIG. 28 illustrates alternate shape embodiments of embedment tiles in accordance with the present invention. Rectangular tiles 550 and wedge-shaped tiles 552 are used in combination to create a generally arc-shaped tactile surface to accommodate a curved curb 556. Preferably, the rectangular tiles 550 are about 48 inches by about 24 inches, and the wedge-shaped tiles 552 are about 24 inches long by about 2 inches wide at the narrow end, and about 8 inches wide at the widest end. Other tile shapes and sizes can be used in the present invention.

Although the present invention has been described in considerable detail with reference to certain preferred versions thereof, other versions are possible. Therefore, the scope of the claims should not be limited to the description of the preferred versions contained herein.

The invention claimed is:

1. An embedment tile assembly comprising:

a lower plate;

a moldable material anchor fixed to the lower plate;

an upper plate joined to the lower plate, and the upper plate includes a plurality of tactile projections and a downwardly extending flange around at least a portion of a perimeter of the upper plate and the flange extends downwardly to an elevation below the surface of the lower plate, and wherein each tactile projection on the upper plate has a substantially conical shape and includes a plurality of ribs and each rib extends outwardly from side and top portions of the tactile projection.

2. The embedment tile assembly of claim 1, wherein the lower plate of the embedment tile includes a plurality of tactile projections.

3. The embedment tile assembly of claim 1, wherein the upper plate of the embedment tile is joined to the lower plate with a plurality of nuts and bolts.

4. The embedment tile assembly of claim 1, wherein the upper plate of the embedment tile is joined to the lower plate with a plurality of nuts fixed to the lower plate, and a plurality of bolts, each bolt extending through a hole in the upper plate and threaded into a nut.

5. The embedment plate assembly of claim 1, wherein the lower plate of the embedment tile defines an air vent to release air from under the lower plate during installation.

6. An embedment tile assembly comprising:

a lower plate;

a moldable material anchor fixed to the lower plate;

an upper plate joined to the lower plate, and the upper plate includes a plurality of tactile projections and a downwardly extending flange around at least a portion of a perimeter of the upper plate and the flange extends downwardly to an elevation below the surface of the lower plate; and wherein the lower plate of the embedment tile includes a plurality of upwardly extending substantially conical domes, and at least one of the conical domes defines an air vent to release air from under the upwardly extending conical dome during installation of the lower plate.

7. The embedment tile assembly of claim 2, wherein the tactile projections on the embedment tile upper plate substantially match tactile projections on the lower plate in shape, size, and spacing.

8. The embedment tile assembly of claim 1, wherein the lower plate of the embedment tile is substantially flat.

* * * * *